US007568691B2

(12) United States Patent
Matsumoto

(10) Patent No.: US 7,568,691 B2
(45) Date of Patent: Aug. 4, 2009

(54) IMAGE FORMING APPARATUS

(75) Inventor: Yuzo Matsumoto, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 129 days.

(21) Appl. No.: 11/737,967

(22) Filed: Apr. 20, 2007

(65) Prior Publication Data

US 2008/0036134 A1 Feb. 14, 2008

(30) Foreign Application Priority Data

May 15, 2006 (JP) ..... 2006-135892
Apr. 3, 2007 (JP) ..... 2007-097891

(51) Int. Cl.
*B65H 3/14* (2006.01)
*G05B 11/28* (2006.01)

(52) U.S. Cl. ..... 271/97; 271/98; 318/599

(58) Field of Classification Search ..... 271/97, 271/98; 318/599
See application file for complete search history.

(56) References Cited

U.S. PATENT DOCUMENTS

| | | | | |
|---|---|---|---|---|
| 5,113,489 | A * | 5/1992 | Cihiwsky et al. | 358/1.14 |
| 5,535,012 | A | 7/1996 | Matsumoto et al. | 358/400 |
| 5,580,045 | A | 12/1996 | Matsumoto et al. | 271/298 |
| 5,645,274 | A | 7/1997 | Ubayashi et al. | |
| 6,021,305 | A | 2/2000 | Sato et al. | 399/374 |
| 6,131,898 | A | 10/2000 | Hiroi et al. | 271/10.03 |
| 6,203,003 | B1 | 3/2001 | Sato et al. | 271/3.01 |
| 6,246,491 | B1 | 6/2001 | Matsumoto et al. | 358/468 |
| 6,471,429 | B1 | 10/2002 | Isobe et al. | 400/582 |
| 6,473,590 | B2 | 10/2002 | Matsumoto et al. | 399/404 |
| 6,493,113 | B1 | 12/2002 | Fujii et al. | 358/488 |
| 6,617,816 | B2 * | 9/2003 | Ohno et al. | 318/560 |
| 6,826,374 | B2 | 11/2004 | Kato et al. | 399/16 |
| 6,871,042 | B2 | 3/2005 | Nemura et al. | 399/389 |
| 6,904,261 | B2 | 6/2005 | Fujii et al. | 399/382 |
| 6,963,722 | B2 | 11/2005 | Matsumoto et al. | 399/404 |
| 7,007,948 | B2 | 3/2006 | Kamiya et al. | 271/221 |
| 7,095,978 | B2 | 8/2006 | Matsumoto et al. | 399/404 |
| 2005/0040584 | A1 * | 2/2005 | Isemura | 271/97 |
| 2007/0228639 | A1 | 10/2007 | Matsumoto et al. | 271/97 |

FOREIGN PATENT DOCUMENTS

| | | |
|---|---|---|
| JP | 7-196187 | 8/1995 |
| JP | 2005-096992 | 4/2005 |

* cited by examiner

*Primary Examiner*—Patrick H Mackey
*Assistant Examiner*—Ernesto Suarez
(74) *Attorney, Agent, or Firm*—Fitzpatrick, Cella, Harper & Scinto

(57) ABSTRACT

A sheet feeding apparatus and an image forming apparatus which can certainly feed sheets without being influenced by an aging change of fan characteristics are provided. An air is blown to sheets stacked on a tray by an air blowing mechanism having a plurality of fans which are independently rotated, thereby loosening the sheets. Prior to starting the feeding of the sheet, rotational speeds of the fans of the air blowing mechanism are controlled so as to be set to target rotational speeds which have been preset every plural fans so that a wind pressure which can loosen the sheets in the driving state of all fans is obtained.

2 Claims, 23 Drawing Sheets

FIG. 8

SPEED CONTROL TARGET VALUE IN THE CASE OF FOUR FANS

| | | (Hz) | PWM (%) |
|---|---|---|---|
| 1st FAN | TARGET VALUE | 182 | 92% |
| | TARGET UPPER LIMIT VALUE | 184 | |
| | TARGET LOWER LIMIT VALUE | 180 | |
| 2nd FAN | TARGET VALUE | 171 | 87% |
| | TARGET UPPER LIMIT VALUE | 173 | |
| | TARGET LOWER LIMIT VALUE | 169 | |
| 3rd FAN | TARGET VALUE | 181 | 91% |
| | TARGET UPPER LIMIT VALUE | 183 | |
| | TARGET LOWER LIMIT VALUE | 179 | |
| 4th FAN | TARGET VALUE | 162 | 82% |
| | TARGET UPPER LIMIT VALUE | 164 | |
| | TARGET LOWER LIMIT VALUE | 160 | |

⇨ 840 Pa IS REALIZED

| SHEET BASIS WEIGHT | COEFFICIENT TO ADJUSTMENT VALUE |
|---|---|
| THIN PAPER | 0.25 |
| PLAIN PAPER | 0.5 |
| THICK PAPER | 0.75 |
| THICKEST PAPER | 1.0 |

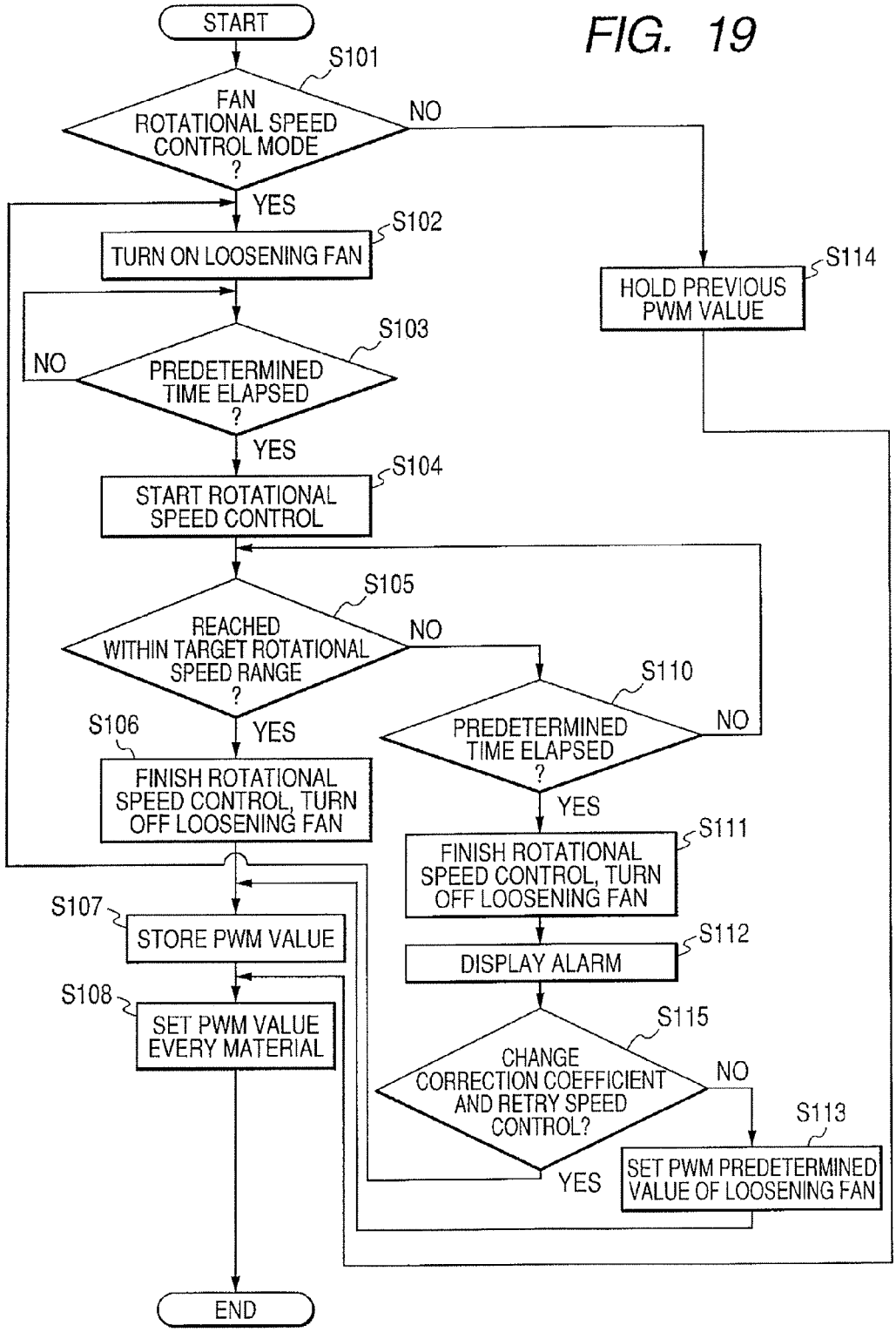
FIG. 19
START
S101
FAN ROTATIONAL SPEED CONTROL MODE ?
NO
YES
S102
TURN ON LOOSENING FAN
S114
HOLD PREVIOUS PWM VALUE
S103
NO
PREDETERMINED TIME ELAPSED ?
YES
S104
START ROTATIONAL SPEED CONTROL
S105
REACHED WITHIN TARGET ROTATIONAL SPEED RANGE ?
NO
S110
PREDETERMINED TIME ELAPSED ?
NO
S106
YES
FINISH ROTATIONAL SPEED CONTROL, TURN OFF LOOSENING FAN
YES
S111
FINISH ROTATIONAL SPEED CONTROL, TURN OFF LOOSENING FAN
S107
STORE PWM VALUE
S112
DISPLAY ALARM
S108
SET PWM VALUE EVERY MATERIAL
S115
CHANGE CORRECTION COEFFICIENT AND RETRY SPEED CONTROL?
NO
S113
YES
SET PWM PREDETERMINED VALUE OF LOOSENING FAN
END

IMAGE FORMING APPARATUS

BACKGROUND OF THE INVENTION

1. Field of the Invention

The present invention relates to an image forming apparatus having a sheet feeding apparatus for feeding sheets after the air was blown to the sheets and the sheets were loosened.

2. Description of the Related Art

Among conventional image forming apparatuses such as copying apparatus, printer, and the like, there is an apparatus having a sheet feeding apparatus for separating sheets stacked on a tray from the top sheet one by one and feeding them to an image forming unit.

As such a sheet feeding apparatus, as disclosed in Japanese Patent Application Laid-Open No. H07-196187, there is an apparatus of a type in which the air is blown to a sheet bundle stacked on a tray, a plurality of sheets is floated and separated, and thereafter, the sheet is adsorbed to an adsorbing and conveying belt and fed.

FIG. 20 is a cross sectional view illustrating an example of a sheet feeding apparatus with such a construction.

In FIG. 20, a container 11 is provided for a main body of an image forming apparatus (not shown) so that is can be freely pulled out. Sheets S are enclosed in the container 11. The container 11 has: a tray 12 which can be freely elevated upward and downward and on which a plurality of sheets S is stacked; and a rear edge regulating plate 13 for regulating a position of a rear edge as an edge on the upstream side in the sheet feeding direction of the stacked sheets S. Further, the container 11 has side edge regulating plates 14 and 16 each for regulating a position of a side edge as an edge in the width direction which perpendicularly crosses the sheet feeding direction of the stacked sheets S. A slide rail 15 which is used to pull out the container 11 from the image forming apparatus main body (not shown) is provided between the image forming apparatus main body and the container 11.

In FIG. 20, an adsorbing and conveying belt 21 adsorbs the sheet and feeds it. An adsorbing fan 36 allows the sheet S to be adsorbed to the adsorbing and conveying belt 21. An air blowing portion 30 blows the air to a front edge of an edge portion on the downstream side in the sheet feeding direction of a sheet bundle SA. The air blowing portion 30 has a separating fan 31, a separating duct 32, a loosening nozzle 33, and a separating nozzle 34. The air blown out by the separating fan 31 is blown toward the sheets from the loosening nozzle 33 and the separating nozzle 34 through the separating duct 32.

In the sheet feeding apparatus with such a construction, when the user pulls out the container 11, sets the sheets S therein, and thereafter, stores the container 11, the tray 12 is lifted up by a driving unit (not shown) in the direction shown by an arrow A in FIG. 21. The tray 12 is stopped at a position where a distance between an upper surface of the sheet bundle SA and the adsorbing and conveying belt 21 is equal to B and, thereafter, prepares for a feeding signal.

Subsequently, when the feeding signal is input, the separating fan 31 of the air blowing portion 30 is made operative and sucks the air in the direction shown by arrows C in FIG. 22. The air is blown toward the front edge surface of the sheet bundle SA from the loosening nozzle 33 and the separating nozzle 34 through the separating duct 32 in the direction shown by arrows D and E, respectively. Thus, a few upper sheets Sa in the sheet bundle SA float and are loosened. On the other hand, the adsorbing fan 36 is made operative and blows the air in the direction shown by arrows F in FIG. 22. At this time, an adsorbing shutter 37 provided for an adsorbing duct 38 is closed.

Auxiliary separating fans 17 and 18 are attached to the side edge regulating plates 14 and 16, respectively. The air from the auxiliary separating fans 17 and 18 is blown to side edges of the sheet bundle SA from openings 14A and 16A. By providing the auxiliary separating fans 17 and 18 as mentioned above, the floating and separation of the sheets Sa are more certainly performed.

Subsequently, when a floating state of a plurality of floating sheets Sa is stabilized after the elapse of a predetermined time after the feeding signal had been input, the adsorbing shutter 37 is rotated in the direction shown by arrows G as shown in FIG. 23. Thus, a sucking force in the direction shown by arrows H is generated by the adsorbing fan 36 from a hole for sucking (not shown) formed in the adsorbing and conveying belt 21. A top sheet Sb in the floating sheets Sa is adsorbed to the adsorbing and conveying belt 21.

By rotating a belt driving roller 41 in the direction shown by arrows J shown in FIG. 25, the sheet is conveyed in the direction shown by an arrow K. Further, the sheet is conveyed to a conveying path on the downstream side by a pulling-out roller pair 42 which is rotated in the direction shown by arrows M and P.

In the sheet feeding apparatus, a degree of ease upon floating of the sheet differs depending on a material (thickness and weight) of the sheet. Therefore, a rotational speed of the separating fan 31 is controlled according to the material of the sheet so as to obtain the optimum floating amount, thereby adjusting a wind pressure of the air which is blown. For example, if the sheet is made of one of a thin material and a light material, the control is made so as to decrease the rotational speed of the separating fan 31. If the sheet is made of one of a thick material and a heavy material, the control is made so as to increase the rotational speed of the separating fan 31. Such a technique has been disclosed in Japanese Patent Application Laid-Open No. 2005-96992.

There has also been proposed such a technique that the material (thickness and weight) of the sheets stacked on the tray 12 is input from an operating unit of the image forming apparatus, thereby controlling so that the air is blown by a predetermined blowing amount according to the input material of the sheet.

In recent years, in association with the realization of a color image in the image forming apparatus, what is called coating paper in which the surface of the sheet has been coated with a coating material as a sheet for color printing is often fed. In the case of such coating paper, there is a case where a force (adsorbing force) by which the sheets are mutually adhered is equal to 10N or more depending on a temperature or a humidity of a use environment.

When such coating paper is separated and fed, in the conventional image forming apparatus in which by blowing the air to the sheet bundle, the sheets are separated and fed, there is a case where such a double feeding that the sheets are conveyed in the overlapped state occurs. Further, there is also a case where ten or more sheets are fed in a lump and a paper jam occurs in the conveying path.

To float the heavy and large sheets whose basis weight is equal to or larger than 200 g/m$^2$, even if it is assumed that there is not an influence of the adsorption between the sheets as mentioned above, a very large wind pressure is necessary in order to simply float. Further, for example, in the case of conveying the sheets of the A4 size at a rate of about 70 to 100 sheets per minute, a time which is necessary for the loosening and separation per sheet (that is, a time which is necessary until the sheet is stably floated) becomes short and there is a risk that the sheet cannot be sufficiently loosened.

A compressor, a large turbo fan, a scirocco fan, or the like is often used as an air blowing portion 30 so that the air of a high pressure can be generated. However, they are typically large, heavy, and high in costs. There is, consequently, a risk of causing a large size, a high price, and the like of the apparatus.

On the other hand, for example, in the case where the coating paper of the A3 size of 200 g/m$^2$ are loosened and conveyed at a rate of 50 sheets per minute in an environment of a room temperature of 30° C. and a relative humidity in a range from 60 to 80%, it has been found from experimental results that the air blowing portion 30 needs to have an ability of accomplishing a wind pressure of 650 Pa (pascal).

Among scirocco fans which are used in the sheet feeding apparatuses of the image forming apparatuses such as a copying apparatus which can output the sheets of the A4 size at a rate of about 50 to 70 sheets per minute and the like, a diameter of impeller of the relatively large scirocco fan is within a range about from 80 to 120 mm. According to such a scirocco fan, the air of the pressure which is fairly higher than that of an axial-flow fan having the same diameter is obtained. However, if the impeller having the diameter of, for example, 120 mm is attached to the air blowing portion 30, the wind pressure of up to about 420 Pa is obtained.

SUMMARY OF THE INVENTION

The invention is made in consideration of such a present situation and it is, therefore, an object of the invention to provide an image forming apparatus which can loosen sheets at an optimum wind pressure by using a small and reasonable fan and can certainly feed them.

According to the invention, there is provided an image forming apparatus having a sheet feeding apparatus for blowing an air to sheets stacked on a tray, loosening the sheets, and feeding the loosened sheet toward an image forming unit, comprising: an air blowing mechanism constructed by combining a plurality of fans in order to blow the air to the sheets stacked on the tray, a control unit which controls the air blowing mechanism so as to form a set wind pressure by combining the plurality of fans, the control unit controlling rotational speeds of at least two of the plurality of fans, individually.

Further features of the present invention will become apparent from the following description of exemplary embodiments with reference to the attached drawings.

BRIEF DESCRIPTION OF THE DRAWINGS

FIG. 8 is a diagram showing speed target values at the time of making rotational speed control of the loosening fan.

FIG. 19 is a flowchart for describing the rotational speed control of the four fans.

DESCRIPTION OF THE EMBODIMENTS

An exemplary embodiment for embodying the invention will be described in detail hereinbelow with reference to the drawings.

Figure 1:
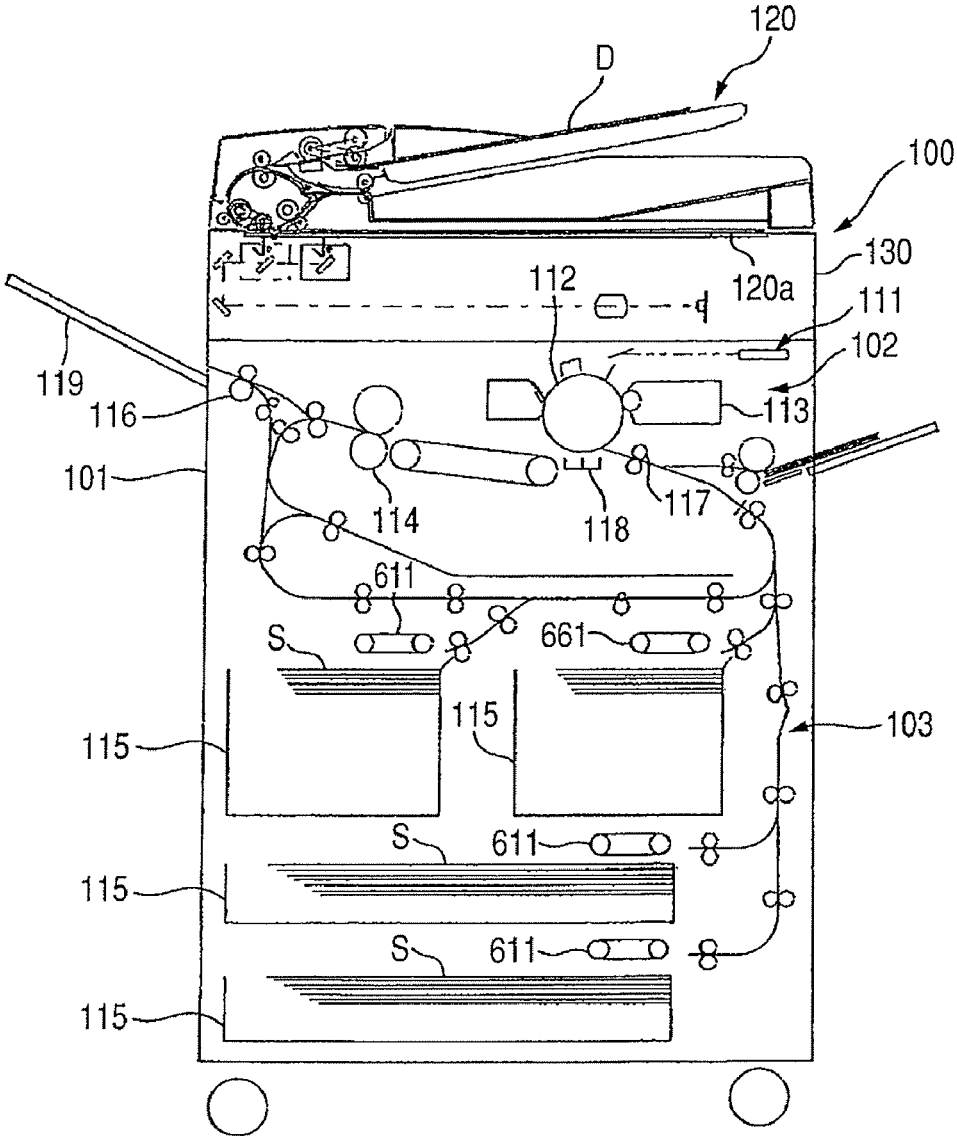
FIG. 1 is a diagram illustrating a schematic construction of a printer as an example of an image forming apparatus according to an embodiment of the invention.

FIG. 1 is a diagram illustrating a schematic construction of a printer as an example of an image forming apparatus having a sheet feeding apparatus according to the embodiment of the invention.

In FIG. 1, an image reading unit 130 for reading an original document (hereinbelow, simply referred to as an original) D put on platen glass 120*a* as a document setting base plate by an automatic document feeder (ADF) 120 is provided in an upper portion of a printer main body 101 of a printer 100. An image forming unit 102 and a sheet feeding apparatus 103 for feeding the sheet S to the image forming unit 102 is provided in a lower portion of the image reading unit 130. A photosensitive drum 112, a developing unit 113, a laser scanner unit 111, and the like are provided for the image forming unit 102. The sheet feeding apparatus 103 has a plurality of sheet enclosing portions 115 and adsorbing and conveying belts 611. Each sheet enclosing portion 115 encloses the sheets S such as OHTs or the like and is detachably attached to the apparatus main body 101. The adsorbing and conveying belt 611 is a feeding belt as an example of a sheet feeding unit for feeding the sheets S enclosed in the sheet enclosing portion 115.

The image forming operation of the printer 100 with such a construction will now be described.

When an image reading signal is output to the image reading unit 130 from a control unit 603 (refer to FIG. 9) provided for the apparatus main body 101, an image is read out by the image reading unit 130. After that, a laser beam corresponding to the image is irradiated from the laser scanner unit 111 onto the photosensitive drum 112.

At this time, the photosensitive drum 112 has previously been charged. By irradiating the light onto the photosensitive drum, an electrostatic latent image is formed on the drum. Subsequently, by developing the electrostatic latent image by the developing unit 113, a toner image is formed on the photosensitive drum.

When the feeding signal is output from the control unit 603 to the sheet feeding apparatus 103, the sheet S is fed from the sheet enclosing portion 115. After that, the fed sheet S is sent to a transfer unit constructed by the photosensitive drum 112 and a transfer charging unit 118 synchronously with the toner image on the photosensitive drum by a registration roller 117.

Subsequently, the toner image is transferred to the sheet sent to the transfer unit in this manner. After that, the sheet is conveyed to a fixing unit 114. Further, thereafter, the toner image is heated and pressed by the fixing unit 114, so that a non-fixed transfer image is permanently fixed onto the sheet S. The sheet on which the image has been fixed as mentioned above is ejected from the apparatus main body 101 to a discharge tray 119 by an ejecting roller 116.

Figure 2:
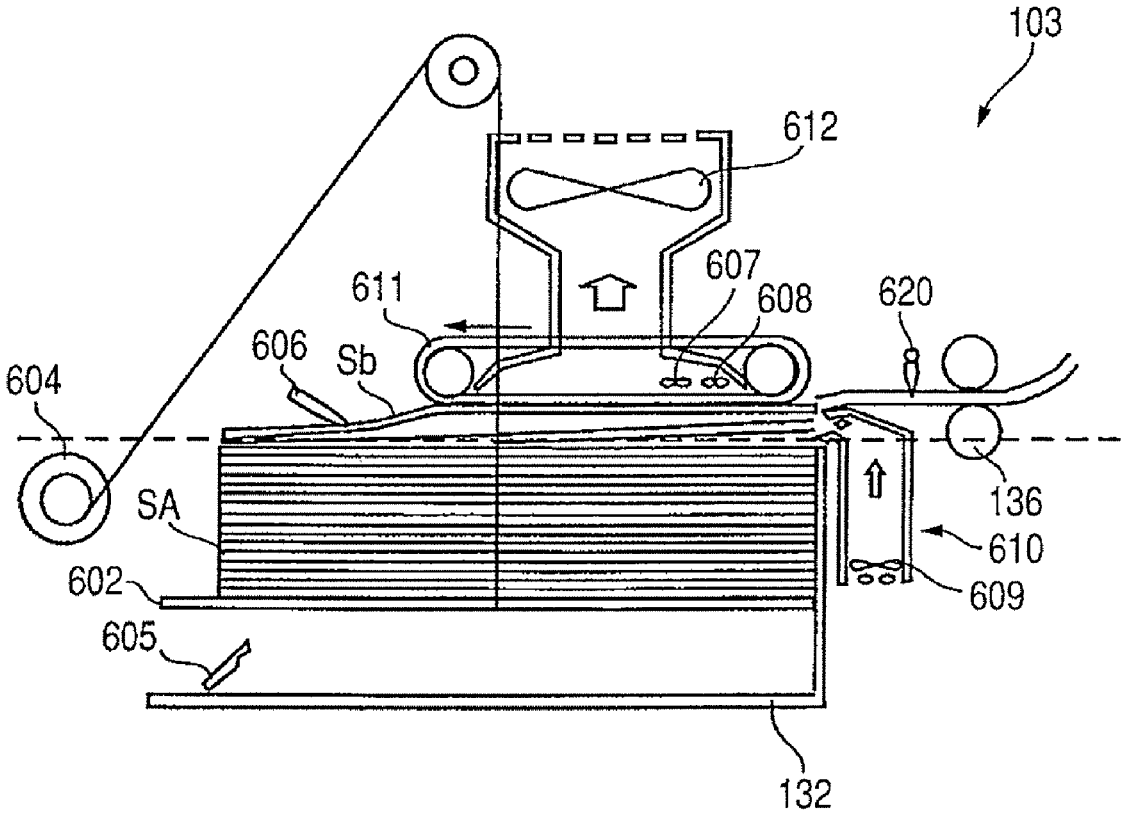
FIG. 2 is a diagram for describing a construction of a sheet feeding apparatus provided for the image forming apparatus.

FIG. 2 is a diagram showing a construction of the sheet feeding apparatus 103. In FIG. 2, a tray 602 which can be freely elevated upward and downward is arranged in a container 132 provided in the sheet enclosing portion 115. A plurality of sheets S is stacked on the tray 602. A lifter 604 for elevating the tray 602 upward and downward, a lower position detecting sensor 605, and a sheet presence/absence detecting sensor 606 are provided for the container 132.

The adsorbing and conveying belt 611 adsorbs the sheet and conveys it. An adsorbing fan 612 allows the adsorbing and conveying belt 611 to adsorb the sheet S. An air blowing unit 610 is an air blowing mechanism for blowing the air to a front edge surface as an edge on the downstream (front) side in the sheet feeding direction of the sheet bundle SA. A loosening fan 609 is provided in the air blowing unit 610. A floating lower limit detecting sensor 607, a floating upper limit detecting sensor 608, and a retry sensor 620 are attached at positions illustrated in the diagram.

In the sheet feeding apparatus 103 with such a construction, when the user pulls out the container 132 provided in the sheet enclosing portion 115, sets the sheets S therein, and thereafter, stores the container 132, the tray 602 is lifted up by the lifter 604. The tray 602 is stopped at a position where a distance between the upper surface of the sheet bundle SA and the adsorbing and conveying belt 611 is equal to a predetermined distance and, thereafter, prepares for the feeding signal.

Subsequently, when the feeding signal is input, the loosening fan 609 is made operative and sucks the air. The air is blown toward the front edge surface of the sheet bundle SA from a loosening nozzle 610*a* and a separating nozzle 610*b* which are provided for the air blowing unit 610 and shown in FIGS. 10A, 10B and 10C, which will be described hereinafter. Thus, a few upper sheets in the sheet bundle SA float.

Subsequently, when a floating state of a plurality of floating sheets is stabilized after the elapse of a predetermined time after the feeding signal had been input, the top sheet Sb among the plurality of floating sheets is adsorbed to the adsorbing and conveying belt 611 by a sucking force applied from the adsorbing fan 612.

By finally rotating the adsorbing and conveying belt 611 in the direction shown by an arrow, the sheet Sb is fed together with the adsorbing and conveying belt 611 and, thereafter, sent to the next conveying path by a pulling-out roller pair 136.

Figure 3:
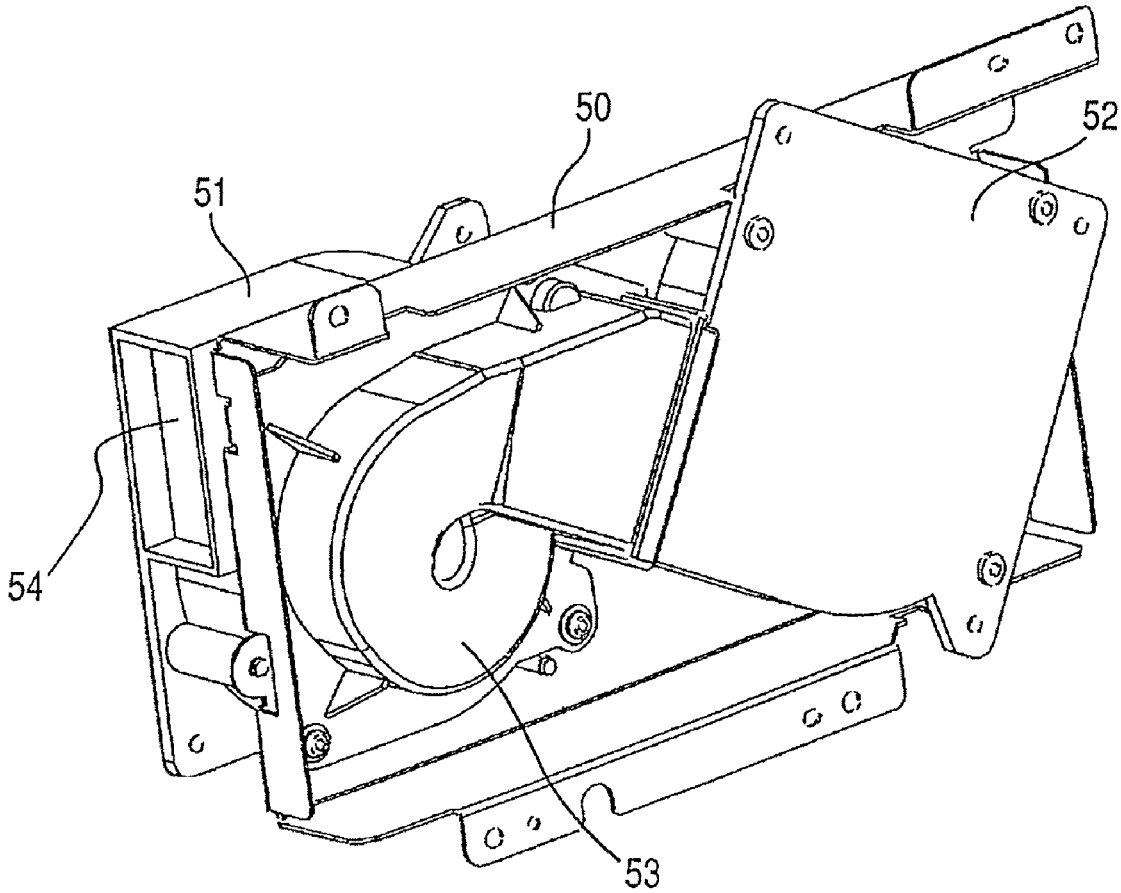
FIG. 3 is a diagram illustrating a construction of a loosening fan provided for the sheet feeding apparatus.
Figure 4:
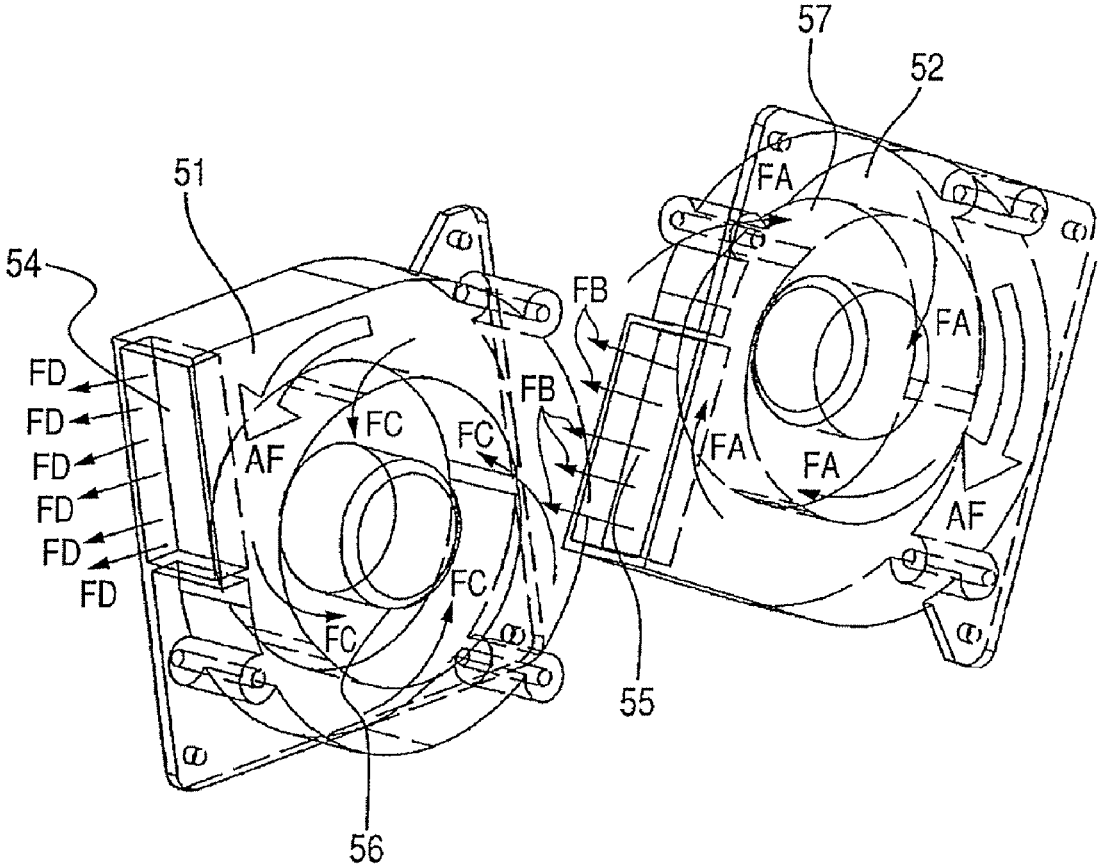
FIG. 4 is a diagram for describing a flow of an air of two scirocco fans constructing the loosening fan.

FIGS. 3 and 4 are diagrams each illustrating a part of a construction of the loosening fan 609, the loosening fan 609 is constructed by combining a plurality of fans. Two fans (scirocco fans) 51 and 52 are fixed to both side surfaces of a supporting base plate 50 so that their air blowout ports 54 and 55 face in almost the same direction, respectively. The air blowout port 55 of the fan 52 on the upstream side in the air flowing direction and an air suction port 56 of the fan 51 on the downstream side are coupled by a coupling air duct 53.

FIG. 4 is a diagram for describing a flow of the air of the two fans 51 and 52. Impellers (not shown) of the two fans 51 and 52 are rotated in the same direction shown by arrows AF in the diagram. The air sucked in the axial direction of the impeller from an air suction port 57 of the scirocco fan 52 on the upstream side is blown out from the air blowout port 55 in the directions shown by arrows FB in the diagram by the impeller of the fan 52. The air passes through the coupling air duct 53 and is sucked to the fan 51 on the downstream side from the directions shown by arrows FC in the diagram. The air is blown out from the air blowout port 54 in the directions shown by arrows FD in the diagram by the impeller of the fan 51.

Figure 5A:
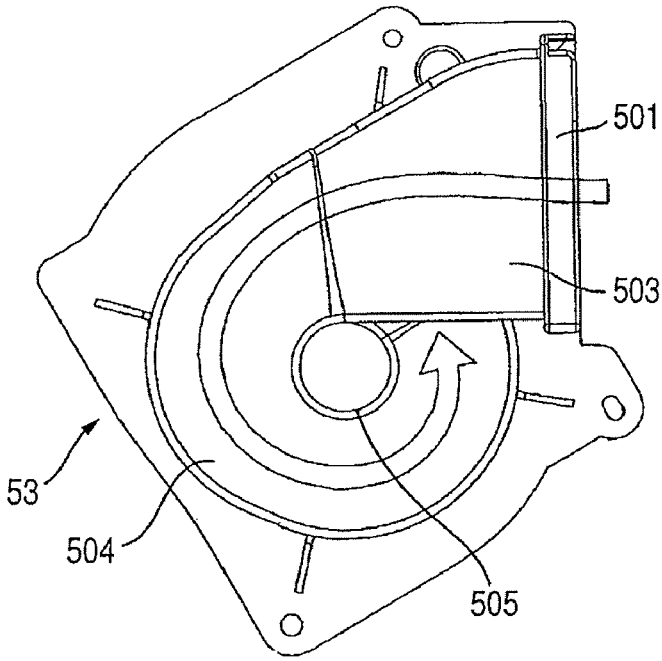
FIGS. 5A, 5B, and 5C are diagrams illustrating a flow of the air in the state where the two scirocco fans of a coupling air duct for coupling the two scirocco fans have been coupled.
Figure 5C:
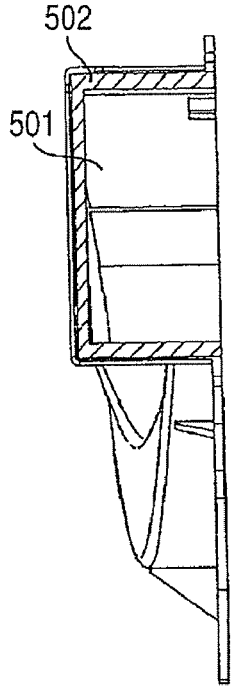
Figure 5B:
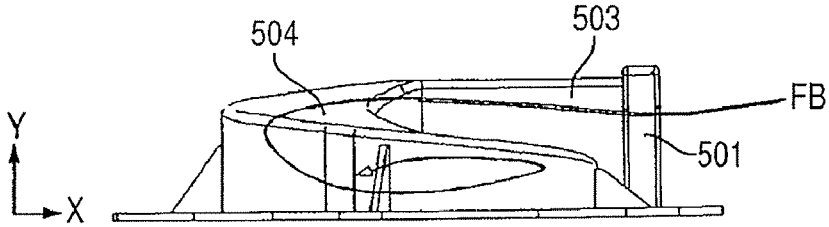

FIGS. 5A, 5B, and 5C illustrate a construction of the coupling air duct 53. An arrow shows a flow of the air in the state where the two fans 51 and 52 have been coupled. An air inlet 501 of the coupling air duct 53 is formed so as to have a size matched with that of the air blowout port 55 of the fan 52 on the upstream side. To prevent an air leakage, the air inlet 501 has been sealed with a soft member 502 (hatched portion in the diagram) such as a sponge.

An air FB blown out of the fan 52 on the upstream side is guided to a counterclockwise spiral passage 504 of the coupling air duct 53 and sucked as an air FC of the fan 51 on the downstream side in FIG. 4. The air sucked into the coupling air duct 53 is gradually converged in an inside 503 of the coupling air duct 53 so as to flow smoothly and is guided to the spiral passage 504.

The spiral passage 504 is rotating counterclockwise and its height decreases gradually in the direction shown by an arrow Y in the diagram. By providing a cylindrical separating wall 505 at the center, the air FB is made to more efficiently circle. A rotational center of the spiral passage 504 coincides with a rotational center of the impeller of the fan 51 on the downstream side in order to smoothly guide the air.

By constructing the apparatus as mentioned above, the air blown out of the fan 52 on the upstream side flows smoothly into the fan 51 on the downstream side, thereby promoting the rotation of the impeller. Therefore, a compression efficiency of the air is improved and the air of a high pressure can be blown out.

Figure 6:
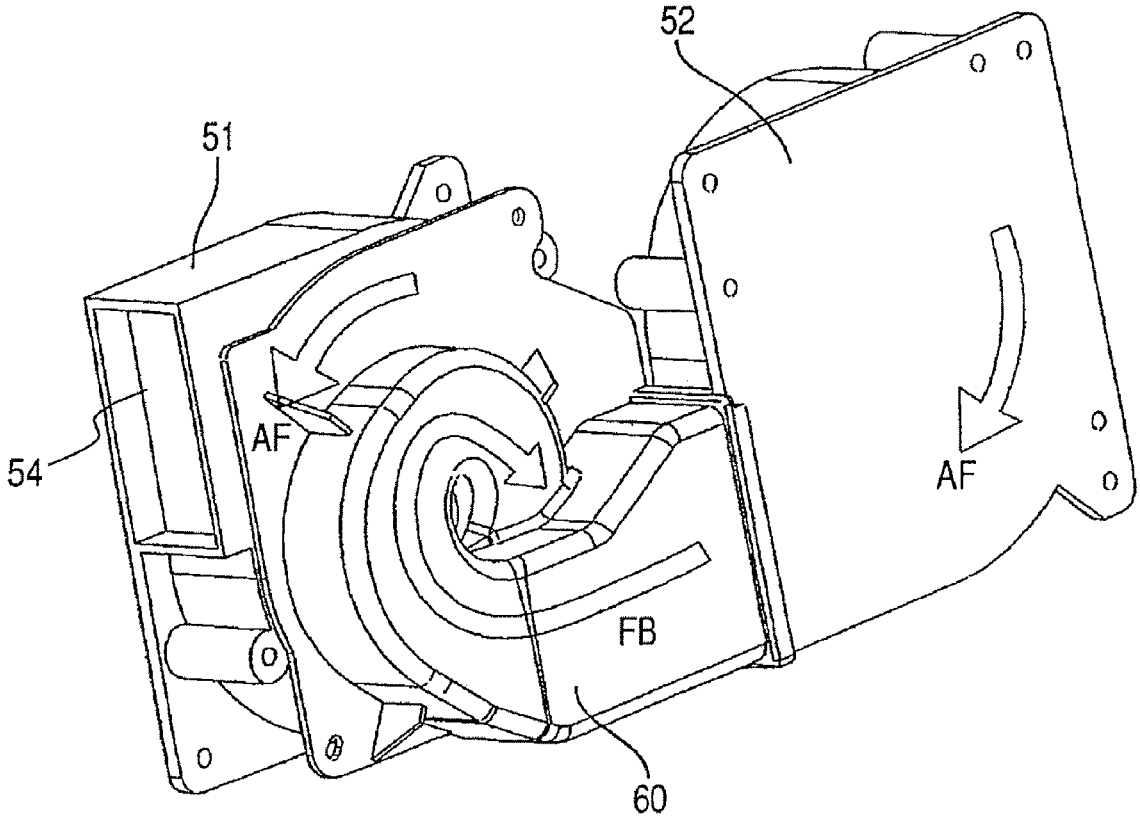
FIG. 6 is a diagram illustrating a construction of a loosening fan according to Comparison of the embodiment.

FIG. 6 is a diagram illustrating a coupling construction of a loosening fan according to Comparison of the embodiment. In the case of this construction, rotating directions of the two fans (scirocco fans) 51 and 52 are the same as the direction shown by the arrow AF in FIG. 4. However, the air FB from the fan 52 on the upstream side circles clockwise opposite to the direction mentioned so far by a coupling air duct 60 and flows into the fan 51 on the downstream side.

That is, the air flows in the direction opposite to the rotating direction AF of the impeller of the fan 51 on the downstream side. The wind pressure is measured under the foregoing conditions in this state, so that it has been found that the obtained wind pressure was decreased by about 10% as compared with that in the case of guiding the air in the same condition as the direction AF by using the coupling air duct 53.

In order to obtain the high pressure by serially coupling the two fans 51 and 52, therefore, it is proper to guide the air from the fan 52 on the upstream side in the same direction as the rotating direction of the impeller of the fan 51 on the downstream side by using the coupling air duct 53.

Although the embodiment has been described with respect to the construction in which the two fans 51 and 52 are coupled, naturally, two or more fans can be coupled by using the same method as that mentioned above. Although the two fans 51 and 52 of the same ability have been coupled in the embodiment, fans of different abilities may be combined. In such a case, it is desirable that the fan having the higher ability is arranged on the upstream side.

Figure 7:
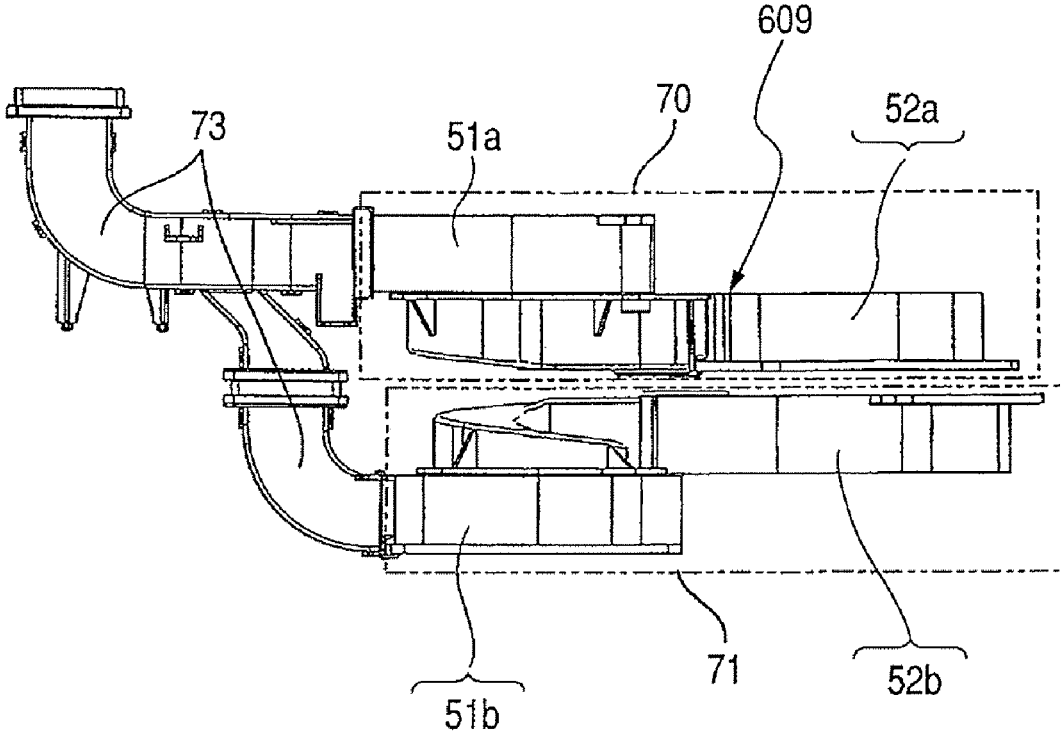
FIG. 7 is a diagram illustrating another construction of a loosening fan using the scirocco fans.

In the embodiment, as illustrated in FIG. 7, the loosening fan 609 is formed in such a manner that the two serially-connected fans are constructed as one unit and two such units are connected in parallel. That is, a unit 70 is formed by serially coupling a first fan 51*a* and a second fan 52*a* through the coupling air duct 60. A unit 71 is formed by serially coupling a third fan 51*b* and a fourth fan 52*b* through the coupling air duct 60. Those two units 70 and 71 are connected in parallel by air duct members 73. Scirocco fans having substantially the same ability are used as those four fans 51*a*, 52*a*, 51*b*, and 52*b*. By constructing as mentioned above, the air of the high pressure can be obtained.

In the embodiment, a fan in which rotational speeds of the first to fourth fans 51*a*, 52*a*, 51*b*, and 52*b* constructing the loosening fan 609 can be monitored is used. Generally, in the fan whose rotational speed can be monitored (detected), in order to make rotational speed control of the fan, a target value is necessary. From characteristics of the fan, it has been found that in the case of rotating the fan at a predetermined PWM (Pulse Width Modulation) setting, a predetermined rotational speed (FG: Frequency Generation) is output and, at the same time, a predetermined wind pressure is obtained.

A method of setting the target value for making the rotational speed control of the loosening fan 609 illustrated in FIG. 7 will now be described. The case of controlling the rotational speeds of the loosening fans in a lump will be described here. In the embodiment, a wind pressure necessary to loosen all types of sheets which are used in the image forming apparatus is set to 840 Pa. The control unit 603 controls the loosening fan 609 so as to form the set wind pressure by combining the first to fourth fans 51*a*, 52*a*, 51*b*, and 52*b*.

Assuming that the first to fourth fans 51*a*, 52*a*, 51*b*, and 52*b* constructing the loosening fan 609 are the scirocco fans having substantially the same performance, it has been confirmed by experiments that when all of the fans are driven at 24V and the PWM of 100%, the necessary wind pressure (840 Pa) is obtained. The rotational speeds of the fans in this instance are set equal to, for example, 182 Hz for the first fan 51*a*, 171 Hz for the second fan 52*a*, 181 Hz for the third fan 51*b*, and 162 Hz for the fourth fan 52*b*, respectively.

The reason why the rotational speeds of the fans differ in the case of rotating the fans under the same conditions (24V, PWM of 100%) will now be described.

When the first fan 51*a* and the second fan 52*a* of the unit 70 are rotated at 24V and the PWM of 100%, the first fan 51*a* on the downstream side is influenced by the wind pressure from the second fan 52*a* on the upstream side and rotates faster. On the contrary, the rotational speed of the second fan 52*a* on the upstream side is lower than that of the first fan 51*a* on the downstream side and becomes stable. In other words, in the case of driving the serially-coupled fans under the same conditions (24V, PWM of 100%), the rotational speed of the fan on the downstream side is higher than that of the fan on the upstream side.

In a unit in which a plurality of fans having substantially the same performance is serially connected, when a target rotational speed is set as shown by the following expression, the air is blown out at a efficient wind pressure.

(rotational speed of the fan on the downstream side)>
(rotational speed of the fan on the upstream side)

That is, it is proper to set the target rotational speed in such a manner that the rotational speed of the fan on the downstream side between the serially-coupled fans is higher.

When the first to fourth fans 51*a*, 52*a*, 51*b*, and 52*b* are controlled at 24V and PWM of 100% as references, there is a risk that they cannot be stably controlled due to a variation in performance of the fans. Therefore, a surplus voltage of, for example, 26.5V is applied to the fans and the value of the PWM is adjusted so that the rotational speeds of the fans can be controlled by the PWM. In this manner, the stable airflow amount can be obtained according to the variation of the fans.

For example, when the first to fourth fans 51*a*, 52*a*, 51*b*, and 52*b* are driven at 26.5V, as shown in FIG. 8, in order to accomplish 182 Hz as a target value of the rotational speed of the first fan 51*a*, the PWM value is set to 92%. Similarly, in order to accomplish 171 Hz as a target value of the rotational speed of the second fan 52*a*, the PWM value is set to 87%. In order to accomplish 181 Hz as a target value of the rotational speed of the third fan 51*b*, the PWM value is set to 91%. In order to accomplish 162 Hz as a target value of the rotational speed of the fourth fan 52*b*, the PWM value is set to 82%.

In the embodiment, as shown in FIG. 8, for example, the rotational speed of the first fan 51*a* is set so that its target value is equal to 182 Hz, an upper limit value of the target rotational speed is equal to 184 Hz, and a lower limit value of the target rotational speed is equal to 180 Hz. The rotational speed of the second fan 52*a* is set so that its target value is equal to 171 Hz, an upper limit value of the target rotational speed is equal to 173 Hz, and a lower limit value of the target rotational speed is equal to 169 Hz. The rotational speed of the third fan 51*b* is set so that its target value is equal to 181 Hz, an upper limit value of the target rotational speed is equal to 183 Hz, and a lower limit value of the target rotational speed is equal to 179 Hz. The rotational speed of the fourth fan 52*b* is set so that its target value is equal to 162 Hz, an upper limit value of the target rotational speed is equal to 164 Hz, and a lower limit value of the target rotational speed is equal to 160 Hz. By adjusting the PWM value so that the rotational speed of each of the fans is within a range of the target set values which have been set as mentioned above, the optimum airflow amount can be obtained.

As for the above target set value, the optimum value has been determined as an examination result in the construction of the invention. It is necessary to independently determine the optimum values for the target value, the target rotational speed upper limit value, and the target rotational speed lower limit value depending on the construction.

Figure 9:
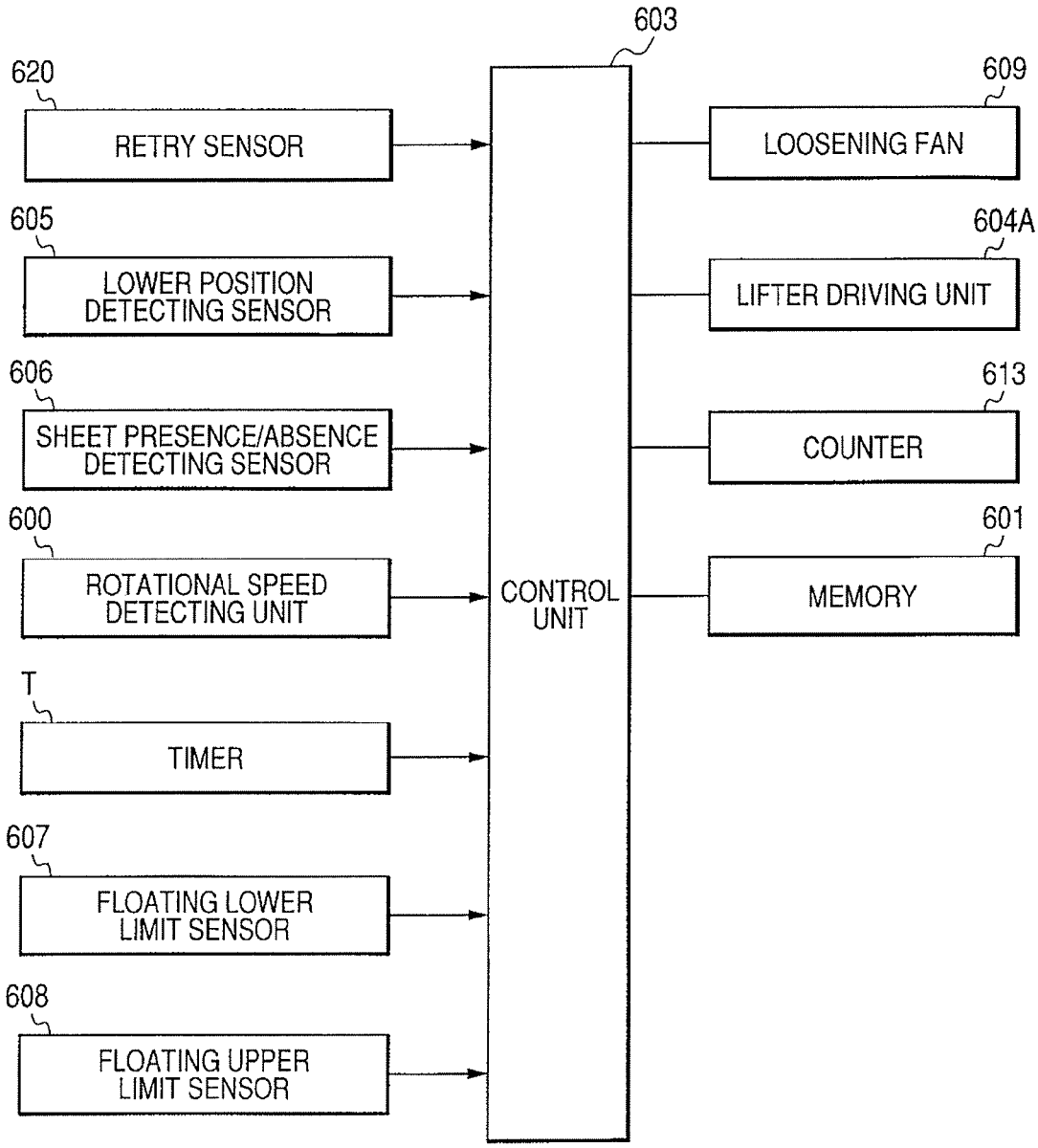
FIG. 9 is a control block diagram of the sheet feeding apparatus.

FIG. 9 is a control block diagram of the sheet feeding apparatus provided for the image forming apparatus of the embodiment. In FIG. 9, detection signals from the retry sensor 620, the lower position detecting sensor 605, the sheet presence/absence detecting sensor 606, a rotational speed detecting unit 600, the floating lower limit detecting sensor 607, and the floating upper limit detecting sensor 608 are input to a control unit 603, respectively. The control unit 603 controls the driving of the loosening fan 609 and a lifter driving unit 604A based on the detection signals from the sensors.

Figure 10A:
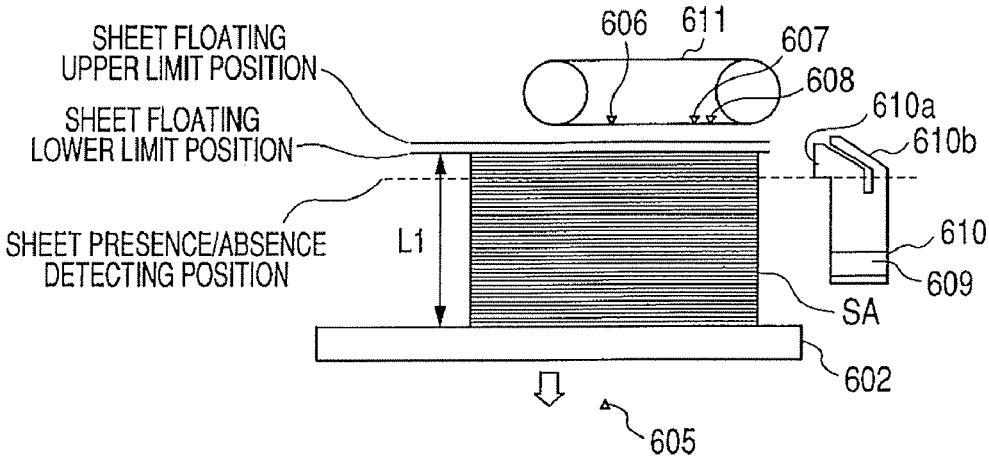
FIGS. 10A, 10B, and 10C are diagrams for describing the rotational speed control of the loosening fan.
Figure 10B:
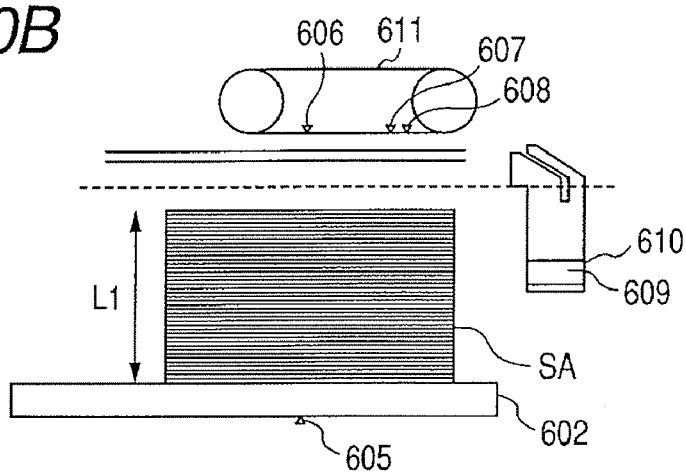
Figure 10C:
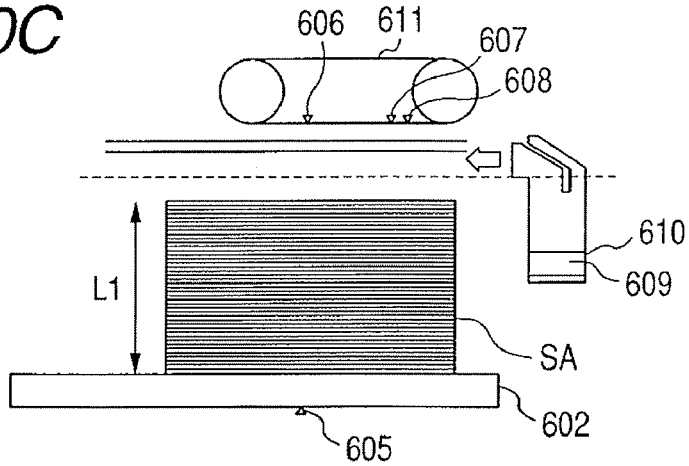

The rotational speed control of the loosening fan 609 will now be described with reference to FIGS. 10A, 10B, and 10C.

When a transition signal to shift the operating mode to the rotational speed control of the loosening fan 609 is detected after a power source was turned on, after a predetermined number of sheets were conveyed by the sheet feeding apparatus 103, or after the elapse of a predetermined time, the rotational speed control of the loosening fan 609 is started.

To enable the rotational speed control of the loosening fan 609 to be normally made, an obstacle must not exist on an extending line of the loosening nozzle 610*a* as an air blowout port through which the air is blown out by the loosening fan 609. For example, when the sheet bundle SA stacked on the tray 602 exists on the extending line of the loosening nozzle 610*a*, since the air passage of the loosening fan 609 is shut off, the normal rotational speed, the normal airflow amount, and the normal wind pressure cannot be obtained.

Therefore, when the transition signal is detected, first, the control unit shown in FIG. 9 drives the lifter driving unit 604A. Thus, as illustrated in FIG. 10A, the descending operation of the tray 602 by the lifter 604 (refer to FIG. 2) is started. As illustrated in FIG. 10B, when the tray 602 is detected by the lower position detecting sensor 605, the driving of the lifter driving unit 604A is stopped, thereby stopping the tray 602. If no sheets are detected by the sheet presence/absence detecting sensor 606 in this state, as illustrated in FIG. 10C, the loosening fan 609 is driven so as to blow out the air and the rotational speed control of the loosening fan is started after the elapse of a predetermined time.

As mentioned above, after the rotation of the fan was stabilized after the elapse of the predetermined time, the rotational speed control is made and the PWM value is adjusted while monitoring (detecting) the rotational speed of the fan so that the rotational speed (FG) of the fan is equal to the predetermined value. As a method of controlling the rotational speed of the fan, there can be mentioned: a method whereby the PWM value is decreased every predetermined value after the fan was rotated at a duty of 100%; and a method whereby the PWM value is increased or decreased by a value obtained by multiplying a coefficient corresponding to a difference between the target value and the actual rotational speed.

By making the rotational speed control after the elapse of the predetermined time after the start of the operation of each of the fans 51*a*, 52*a*, 51*b*, and 52*b*, for example, the PWM values which are obtained after the fan rotational speed control was normally finished are set to 92% with respect to the first fan 51*a*, to 87% with respect to the second fan 52*a*, to 91% with respect to the third fan 51*b*, and to 82% with respect to the fourth fan 52*b* as shown in FIG. 8, respectively.

The PWM values of the four fans 51*a*, 52*a*, 51*b*, and 52*b* in this instance are stored into a memory 601 as a storing unit shown in FIG. 9. Although the case of the four fans has been described above, another plural number of fans can be connected. Initial speeds (PWM values) of the fans can be set to the same value or set to the optimum values, respectively. Further, the PWM value which is obtained after the previous rotational speed control was normally finished may be set to the initial speed.

Figures 11, 12:
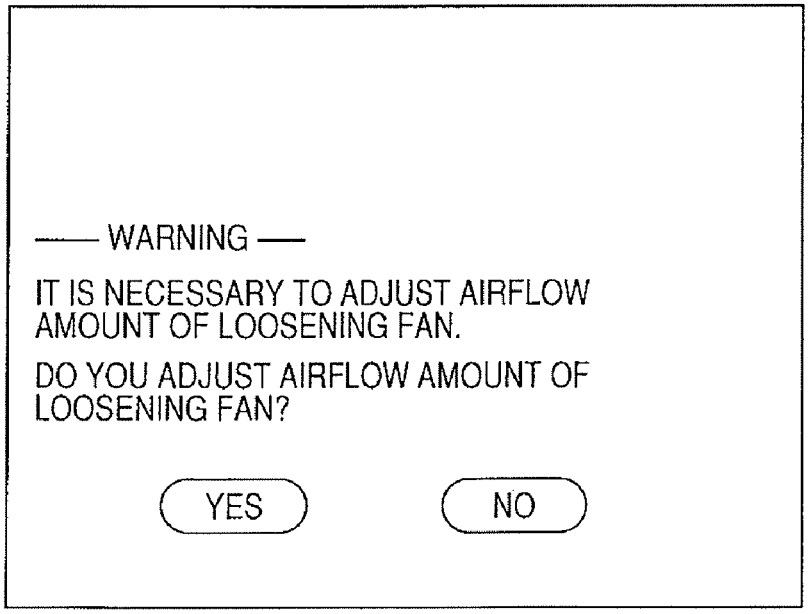
FIG. 11 is a diagram showing coefficients for sheet conditions.
FIG. 12 is a diagram showing an operation display screen for selecting the rotational speed control of the loosening fan.

It is necessary to adjust the PWM value according to the sheet type. The PWM value adjustment is performed by using coefficients according to the sheet types shown in FIG. 11. FIG. 11 shows an example and the coefficients can be properly changed.

The control for adjusting the PWM value according to the sheet type is made after the normal end of the rotational speed control of the four fans 51*a*, 52*a*, 51*b*, and 52*b*.

In the apparatus, as shown in FIG. 8, it is assumed that 840 Pa was obtained as a maximum wind pressure when the PWM values are controlled to 92% for the first fan 51*a*, to 87% for the second fan 52*a*, to 91% for the third fan 51*b*, and to 82% for the fourth fan 52*b*, respectively. The data of the PWM values has been stored in the memory 601.

The PWM values stored in the memory 601 are adjusted according to the coefficients shown in FIG. 11 based on the sheet types. If thickest paper is selected, since the coefficient is equal to 1.0, the PWM value of the first fan 51*a* is set to 92%×1.0=92%, the PWM value of the second fan 52*a* is set to 87% ×1.0=87%, the PWM value of the third fan 51*b* is set to 91%×1.0=91%, and the PWM value of the fourth fan 52*b* is set to 82%×1.0=82%.

If thick paper is selected, since the coefficient is equal to 0.75, the PWM value of the first fan 51*a* is set to 92%× 0.75=69%, the PWM value of the second fan 52*a* is set to 87%×0.75=65.25%, the PWM value of the third fan 51*b* is set to 91%×0.75 =68.25%, and the PWM value of the fourth fan 52*b* is set to 82%×0.75=61.5%, respectively.

If plain paper is selected, since the coefficient is equal to 0.5, the PWM value of the first fan 51*a* is set to 92%×0.5=46%, the PWM value of the second fan 52*a* is set to 87%×0.5=43.5%, the PWM value of the third fan 51*b* is set to 91%×0.5=45.5%, and the PWM value of the fourth fan 52*b* is set to 82%×0.5=41%, respectively.

If thin paper is selected, since the coefficient is equal to 0.25, the PWM value of the first fan 51*a* is set to 92%× 0.25=23%, the PWM value of the second fan 52*a* is set to 87%×0.25=21.75%, the PWM value of the third fan 51*b* is set to 91%×0.25 =22.75%, and the PWM value of the fourth fan 52*b* is set to 82%×0.25=20.5%, respectively.

In this manner, by multiplying the coefficient according to the sheet type to the PWM value at the time of the maximum wind pressure, the air is blown out at the optimum wind pressure.

When the operation of a job is continued after the predetermined number of sheets were conveyed by the adsorbing and conveying belt 611, the rotational speed control of the loosening fan 609 (fans 51*a*, 52*a*, 51*b*, and 52*b*) may be made after the end of the job or before the start of the job. As shown in FIG. 12, the apparatus can be also constructed so that the user selects from an operation display screen whether or not the rotational speed control is made.

Figure 13A:
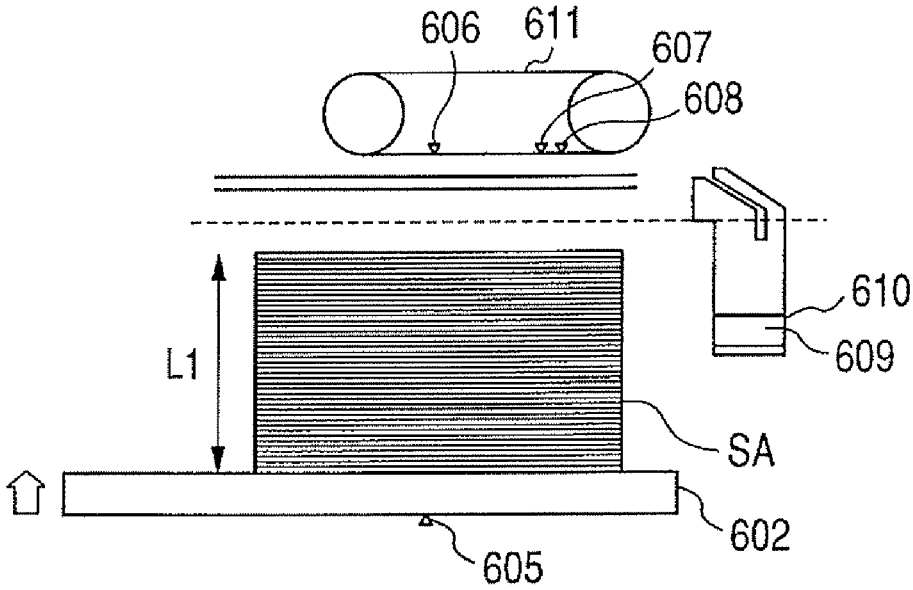
FIGS. 13A and 13B are diagrams for describing the operation which is executed after the rotational speed control of the loosening fan was started.
Figure 13B:
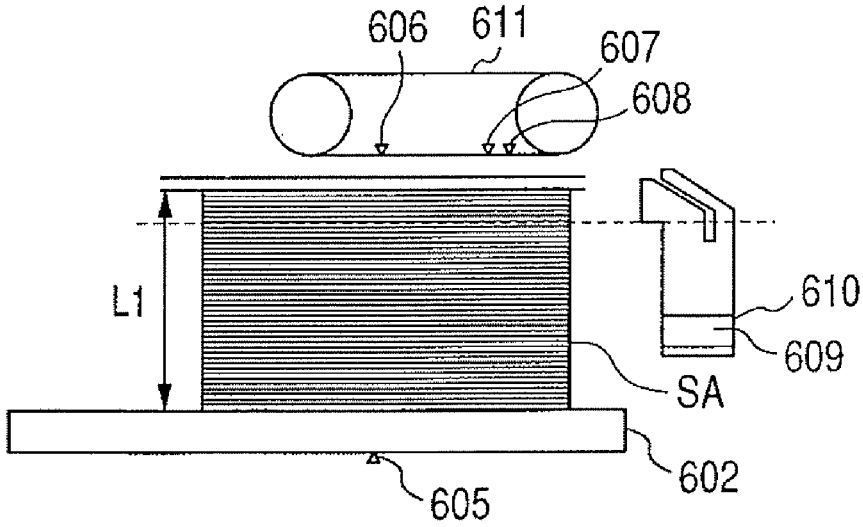

The operation which is executed after the rotational speed control of the loosening fan 609 was started will now be described with reference to FIGS. 13A and 13B.

In the embodiment, it is assumed that the fans 51*a*, 52*a*, 51*b*, and 52*b* are constructed so that the rotational speeds can be monitored. Information showing the rotational speeds are input from the fans to the control unit 603. The rotational speed detecting unit 600 for detecting the rotational speeds of the fans 51*a*, 52*a*, 51*b*, and 52*b* may be provided as shown in FIG. 9. When the rotational speed control of the loosening fan 609 is started, the control unit 603 as a control device makes a timer T operative and discriminates whether or not the rotational speed is within the target rotational speed range shown in FIG. 8 within a predetermined time. In this adjustment, if it is determined by the control unit 603 that there is a fan whose rotational speed is not within the target rotational speed range among the fans 51*a*, 52*a*, 51*b*, and 52*b*, the PWM value of the fan whose rotational speed is not within the target rotational speed range is adjusted.

If the rotational speed is within the target rotational speed range within a predetermined time after the start of the rotational speed control of the loosening fan 609, the control is made so as to finish the rotational speed control of the loosening fan 609 and stop the loosening fan 609. At the same time, the tray 602 is lifted up by the lifter driving unit 604A. When the top surface of the sheet put on the tray 602 is detected by the floating lower limit detecting sensor 607, the lifter driving unit 604A is stopped.

Figure 14:
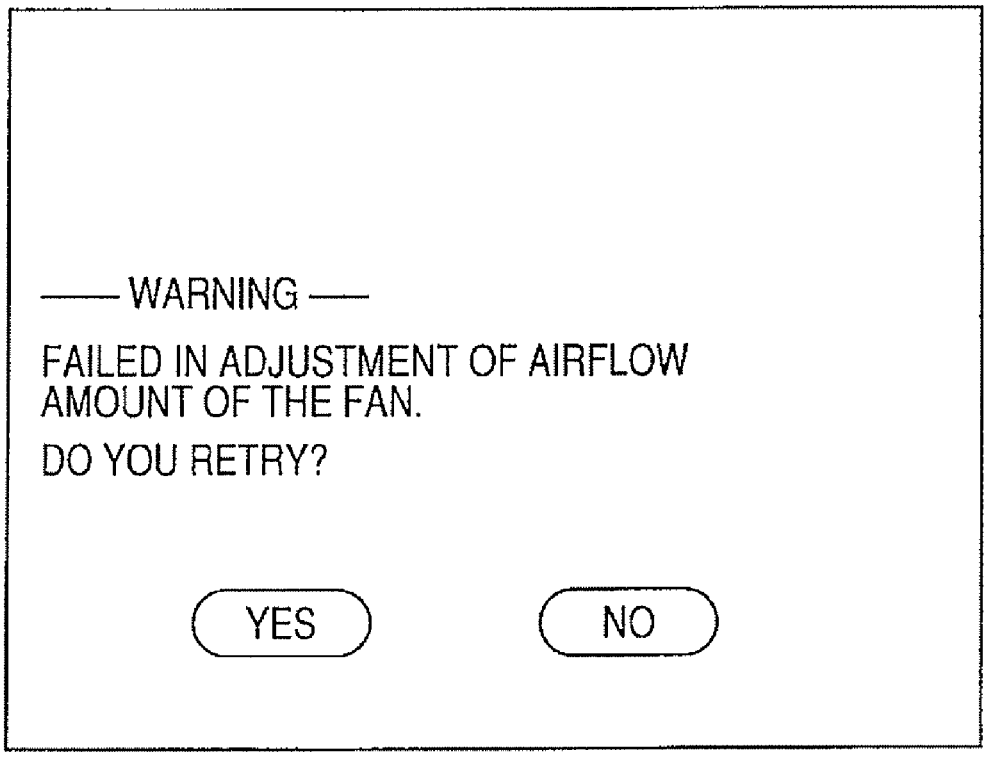
FIG. 14 is a diagram showing a warning on the operation display screen in the case where the apparatus failed in the rotational speed control of the loosening fan.

If the rotational speed is not within the target rotational speed range within the predetermined time after the start of the rotational speed control of the loosening fan 609, the control is made so as to finish the rotational speed control of the loosening fan 609 and stop the loosening fan 609. Subsequently, as shown in FIG. 14, a warning showing that the apparatus failed in the rotational speed control of the loosening fan 609 is displayed on an operation display screen. Although an alarm message is shown here so as to retry the rotational speed control of the loosening fan 609, an error can be also displayed. The warning for the rotational speed control may be also displayed earlier than the operation stop timing of the loosening fan 609.

In the embodiment, after the power source was turned on, after the predetermined number of sheets were conveyed by the adsorbing and conveying belt 611, or after the elapse of the predetermined time, the rotational speed control (adjusting mode) of the loosening fan 609 is performed by the control unit 603 shown in FIG. 9. That is, the sheet feeding apparatus of the embodiment has a mode for making the rotational speed control of the loosening fan 609.

The number of sheets conveyed by the adsorbing and conveying belt 611 is counted by a counter 613 for counting the number of leading edges or trailing edges of a signal output of the retry sensor 620 or a pulling-out sensor (not shown).

The operation in the adjusting mode of the sheet feeding apparatus 103 will now be described with reference to a timing chart of FIG. 15.

The operation of the sheet feeding apparatus 103 and the operation of the loosening fan 609 which are executed after the loosening fan 609 entered the rotational speed control mode, for example, after the power source was turned on, after the predetermined number of sheets were conveyed by the sheet feeding apparatus, or after the elapse of the predetermined time will now be mainly described. Although the active states of all signals in FIG. 15 are at the H (high) level (the detection is executed at H, the operation is executed at H, and the signal is valid at H), they may be also set to the L (low) level (the detection is executed at L, the operation is executed at L, and the signal is valid at L).

For example, when a start signal of the rotational speed control is set to H (made active) in order to enter the rotational speed control of the loosening fan 609 after the turn-on of the power source, first, the control unit 603 drives the lifter driving unit 604A so that the tray 602 descends.

Subsequently, when the tray 602 reaches the lower position detecting sensor 605, control is made in such a manner that the lifter driving unit 604A is stopped, and if a no-sheet state is detected based on a signal from the sheet presence/absence detecting sensor 606, the loosening fan 609 is driven.

Subsequently, the rotational speed control (adjusting mode) of the loosening fan 609 is started after the elapse of a predetermined time T1 after the start of the operation of the loosening fan 609. When the rotational speed control is started, the rotational speed of the loosening fan 609 is detected by the rotational speed detecting unit.

If the rotational speed of the loosening fan 609 is within a predetermined rotational speed range within a predetermined time T2, a normal end signal showing that the rotational speed control has normally been finished is output. Thus, the rotational speed control of the loosening fan 609 is finished and the operation of the loosening fan 609 is stopped.

Figure 15:
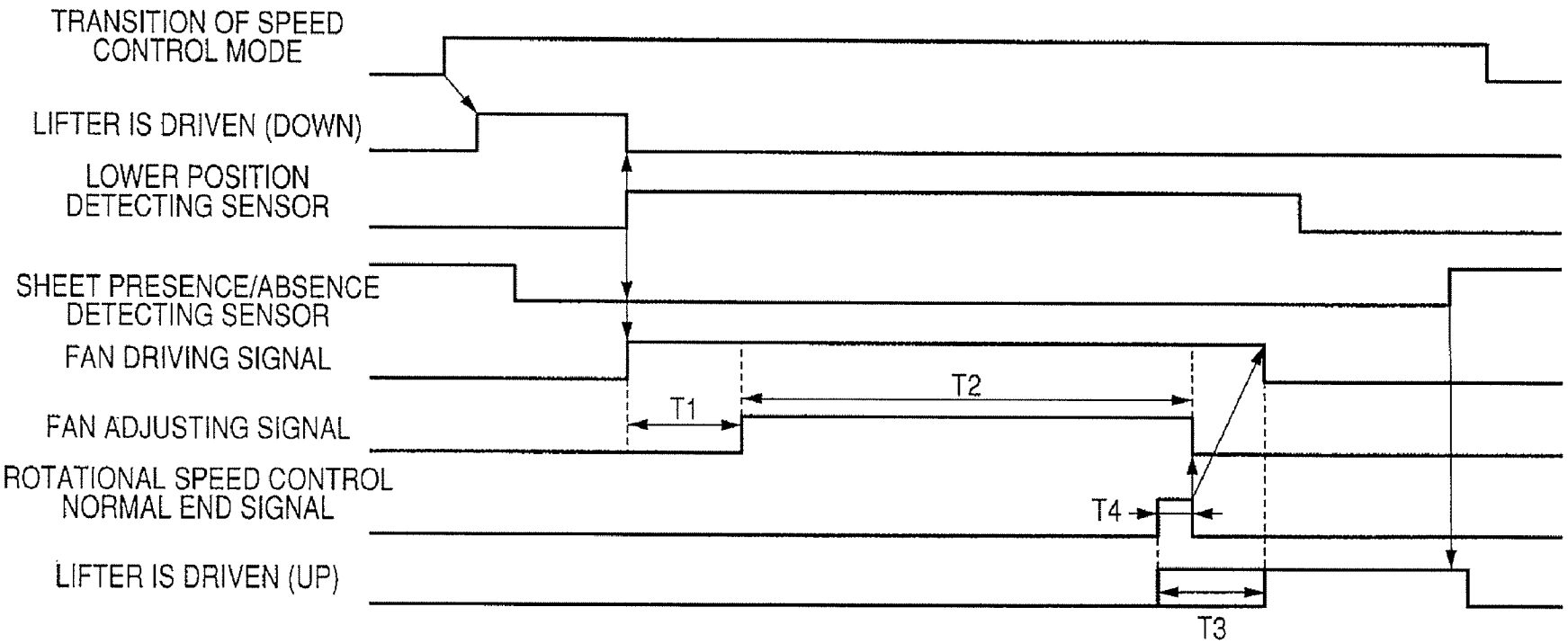
FIG. 15 is a timing chart in a range from the start of the rotational speed control of the loosening fan to the normal end thereof.

In FIG. 15, the rotational speed control is finished after the elapse of a time T4 after the normal end signal of the rotational speed control had been output. However, it is also possible to control in such a manner that when the H-level state of the normal end signal has continued a predetermined number of times at regular intervals, it is determined that the rotational speed control has normally been finished. FIG. 15 shows the state where the rotational speed control has been finished within the predetermined time T2.

After the operation of the loosening fan 609 was stopped as mentioned above, the lifter driving unit 604A is driven, thereby lifting the tray 602 up. When the presence of the sheet is detected by the sheet presence/absence detecting sensor 606, the lifter driving unit 604A is stopped and the tray 602 is stopped. Thus, the sheet feeding apparatus 103 enters the standby mode where the sheet feeding can be started any time in response to a sheet feed start signal.

It is proper that an elevation start timing of the tray 602 is within a time interval (T3) from the turn-on of the normal end signal of the rotational speed control to the turn-off of a fan driving signal. The timing in FIG. 15 is shown as an example. With respect to the transition states shown by arrows, the control mode can be shifted either at the same time or with a delay time.

Further, although the lifter driving unit 604A is stopped based on the signal from the sheet presence/absence detecting sensor 606 after the tray 602 was lifted up, the lifter driving unit 604A can be also stopped based on the signal from one of the floating lower limit detecting sensor 607 and the floating upper limit detecting sensor 608.

Figure 16:
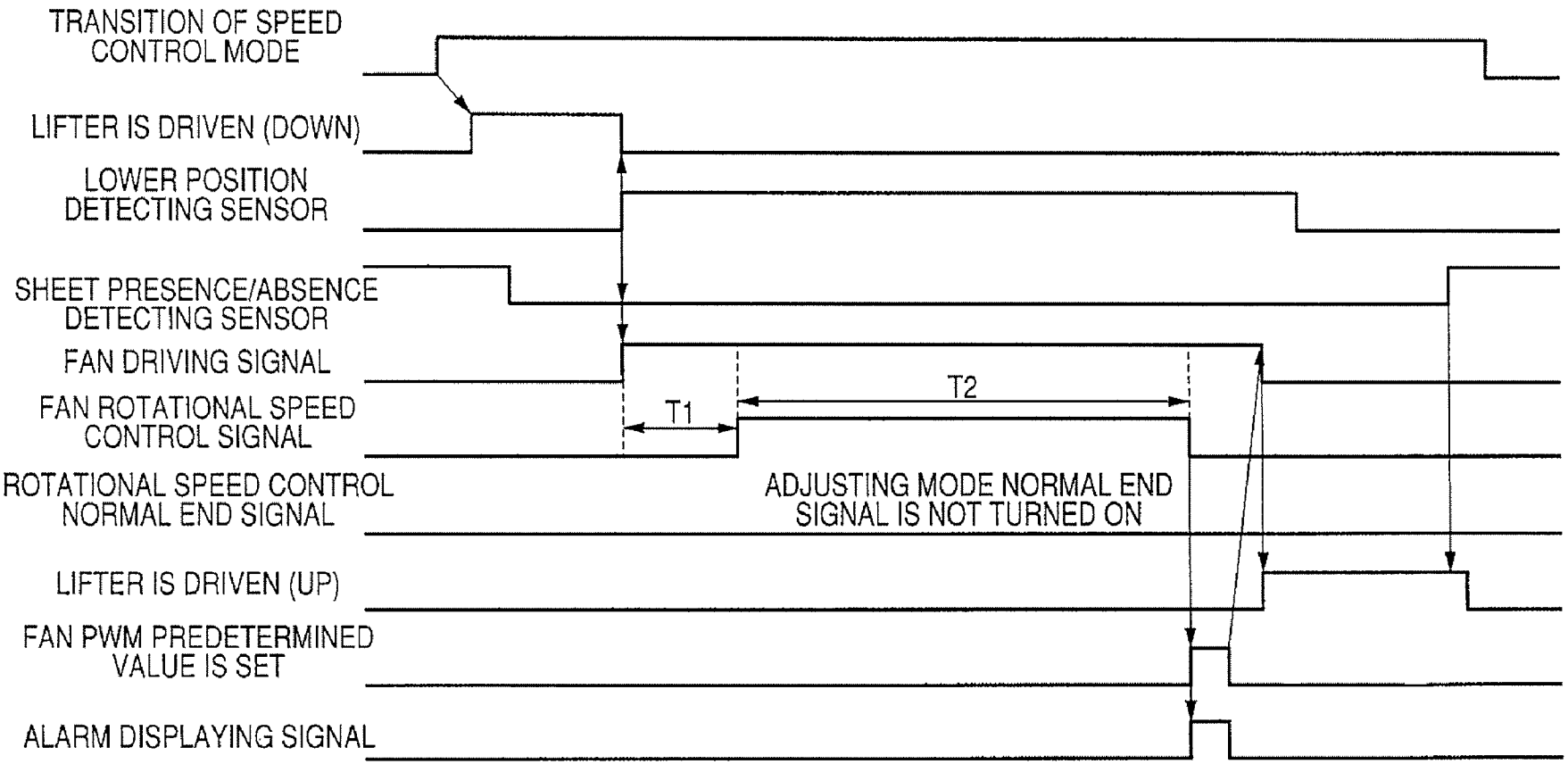
FIG. 16 is a timing chart for describing the control which is made after the apparatus failed in the rotational speed control of the loosening fan.

The case where the apparatus failed in the rotational speed control of the loosening fan 609 will now be described with reference to a timing chart of FIG. 16.

As already mentioned above, the rotational speed control (adjusting mode) of the loosening fan 609 is started after the elapse of the predetermined time T1 after the start of the operation of the loosening fan 609 and the rotational speed of the loosening fan 609 is detected by the rotational speed detecting unit.

If the rotational speed of the loosening fan 609 is not within the predetermined rotational speed range within the predetermined time T2, the rotational speed control of the loosening fan 609 is finished and, at the same time, a warning showing the failure of the rotational speed control is displayed as shown in FIG. 14. After that, control is made so as to stop the operation of the loosening fan 609. As mentioned above, if the apparatus failed in the rotational speed control of the loosening fan 609, the rotational speed can be also set by the previous PWM value stored in the memory 601 after that.

Figure 17:
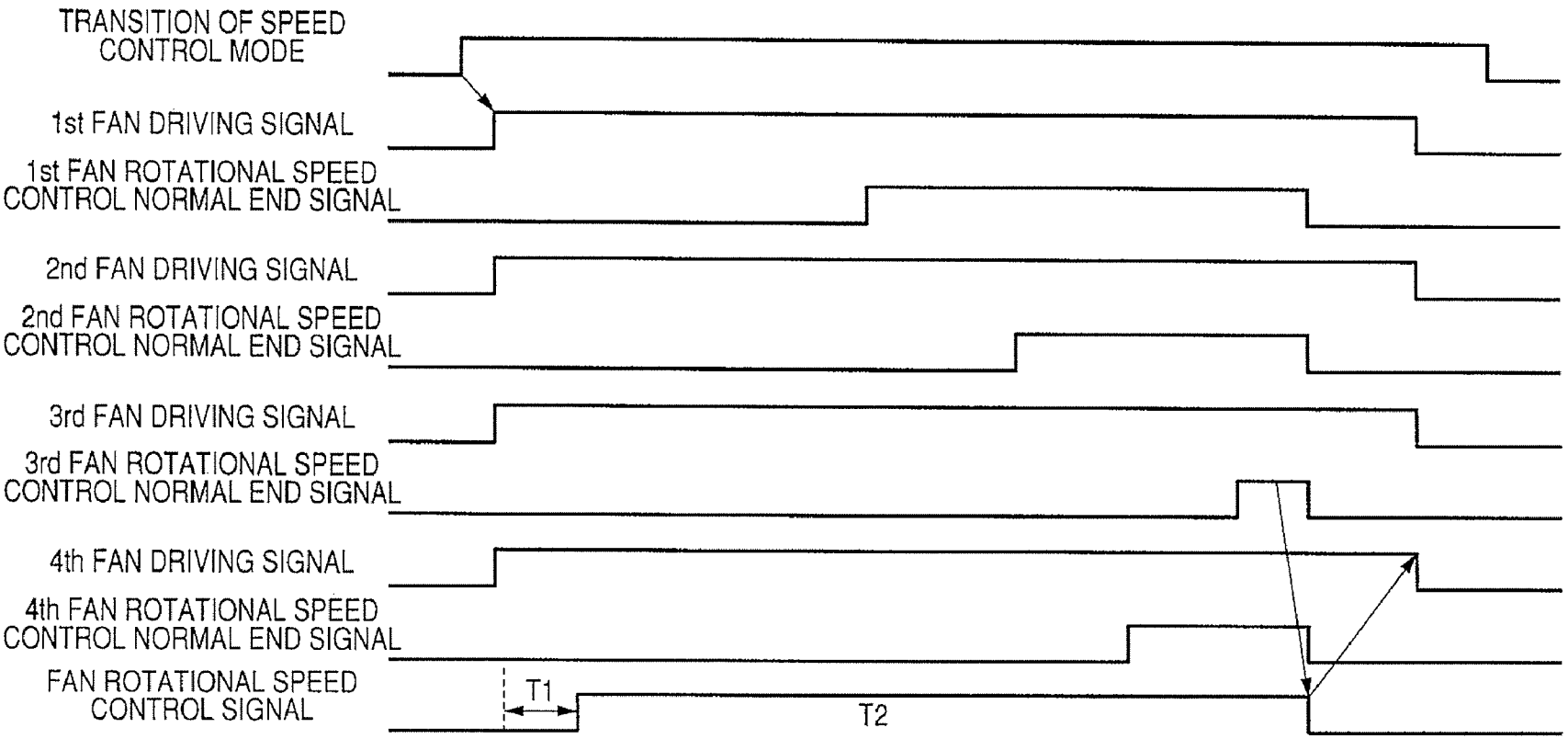
FIG. 17 is a timing chart in the case where the rotational speed control for the four fans has normally been completed.
Figure 18:
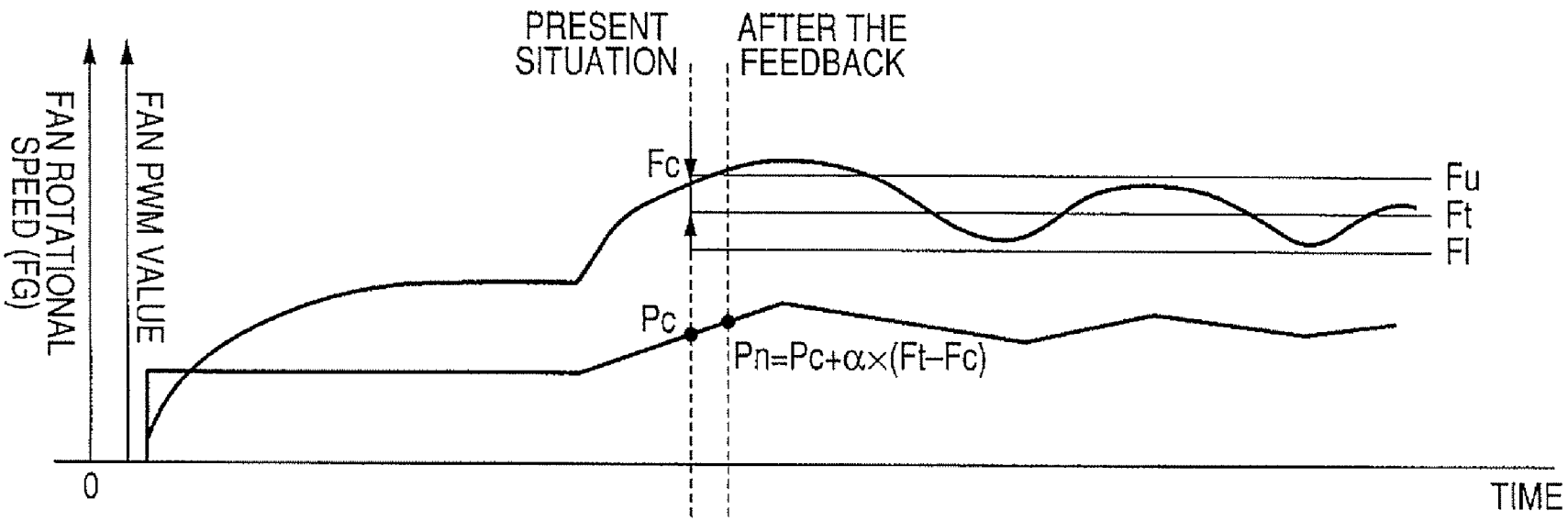
FIG. 18 is a diagram showing the state when a rotational speed of the fan is controlled by a PWM.

The rotational speed control in the case where the four fans 51*a*, 52*a*, 51*b*, and 52*b* (hereinbelow, referred to as 51*a* to 52*b*) according to the embodiment will now be described with reference to a timing chart of FIG. 17.

When the control mode is shifted to the rotational speed control of the fans 51*a* to 52*b*, driving signals of the first to fourth fans (refer to FIG. 7) are output and the first to fourth fans 51*a* to 52*b* start to rotate. However, activating timing for the first to fourth fans 51*a* to 52*b* may be set to the same timing or may have time differences among them.

Assuming that a time enough to allow all of the first to fourth fans 51*a* to 52*b* to reach a stable rotational speed is set to T1, a start signal of the rotational speed control of the first to fourth fans 51*a* to 52*b* is output after the elapse of T1. Thus, the rotational speed control is simultaneously started to the first to fourth fans 51*a* to 52*b*. When the start signal of the rotational speed control of the fans is turned on and the normal end signal of the rotational speed control of the first to fourth fans 51*a* to 52*b* is output within the predetermined time T2, the start signal of the rotational speed control of the fans is turned off. Thereafter, the driving signals of the first to fourth fans 51*a* to 52*b* are turned off after the elapse of the predetermined time.

A rotational speed control method of the fans in the embodiment will now be described based on FIG. 19. Description will be made hereinbelow with respect to one of the first to fourth fans 51*a* to 52*b*.

In FIG. 19, it is assumed that a center value of the target FG as a rotational speed of the fan is set to Ft, an upper limit value of the target FG is set to Fu, a lower limit value of the target FG is set to Fl, a current PWM value of the fan is set to Pc, a current FG value of the fan is set to Fc, and a fan correction coefficient is set to α. This fan correction coefficient is a coefficient for feeding back a difference between the target FG value and the current fan FG value to the current PWM value Pc of the fan.

A PWM value which is obtained after such a difference was fed back to Pc is assumed to be Pn. Now assuming that a feedback value of the fan to the PWM value is set to δ, the following equations are satisfied.

$$\delta=\alpha\times(Ft-Fc)$$

$$Pn=Pc+\delta$$

If Fc>Ft here, the feedback value δ is a negative value and control is made so as to decrease the rotational speed of the fan. If Fc<Ft, the feedback value δ is a positive value and control is made so as to increase the rotational speed of the fan. Further, if Fc=Ft, control is made so that the rotational speed of the fan is not changed. In this manner, the rotation of the fan whose adjustment is necessary is controlled by the new PWM value Pn.

The rotational speed control of the fans is made simultaneously or almost simultaneously to the first to fourth fans 51*a* to 52*b*. As a time necessary to perform the feedback, at least a time which is required until the rotational speed of the fan is stabilized after the adjustment of the PWM value of the loosening fan is necessary. Further, as for the correction coefficient α, it is necessary to set the feedback value δ to a value which can be fed back to the PWM value. If the feedback value δ is large, there is a case where the rotational speed of the fan is not settled. If the feedback value δ is small, there is a case where it takes a long time until the rotational speed control of the fan is finished. Therefore, it is necessary to set α to the optimum value.

Figure 20:
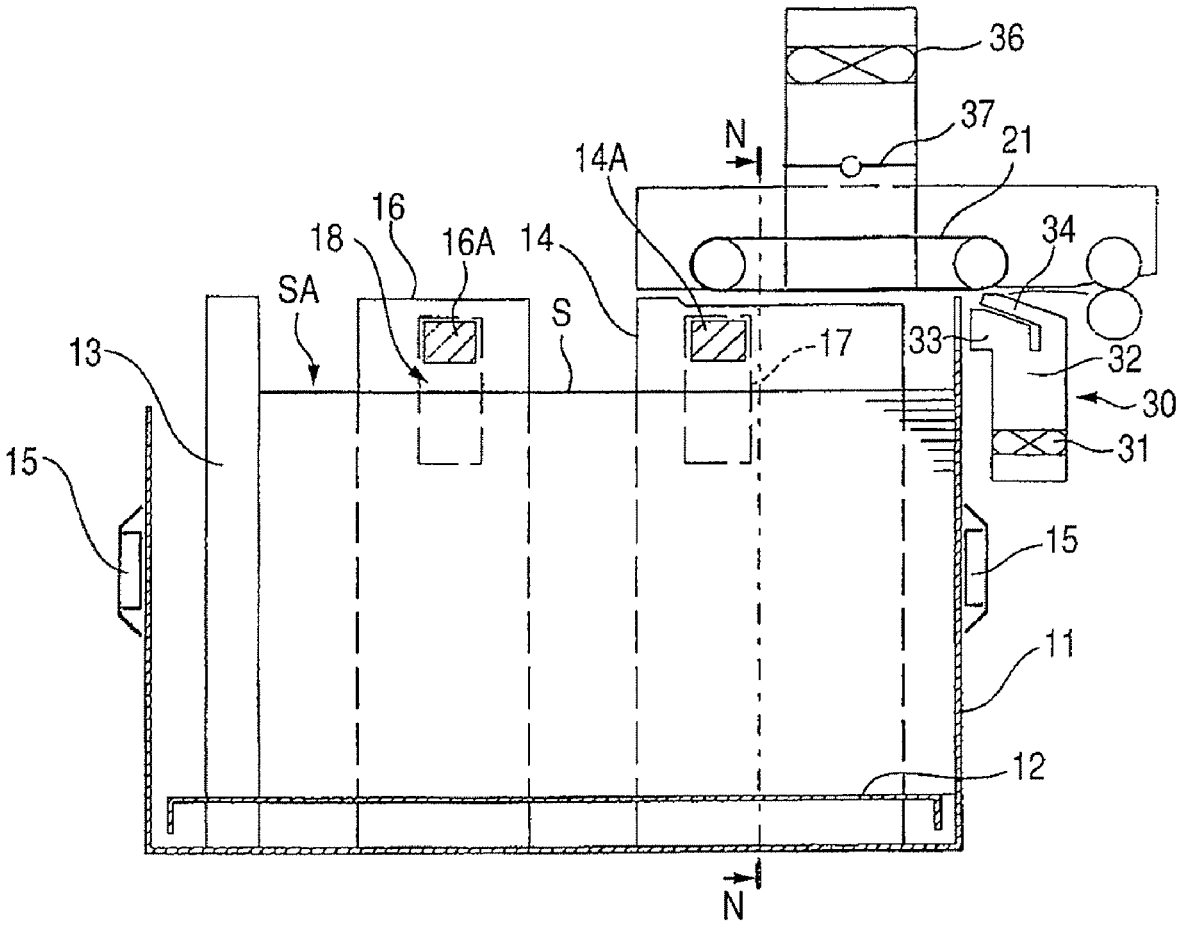
FIG. 20 is a schematic constructional diagram illustrating an example of a sheet feeding apparatus provided for a conventional image forming apparatus.
Figure 21:
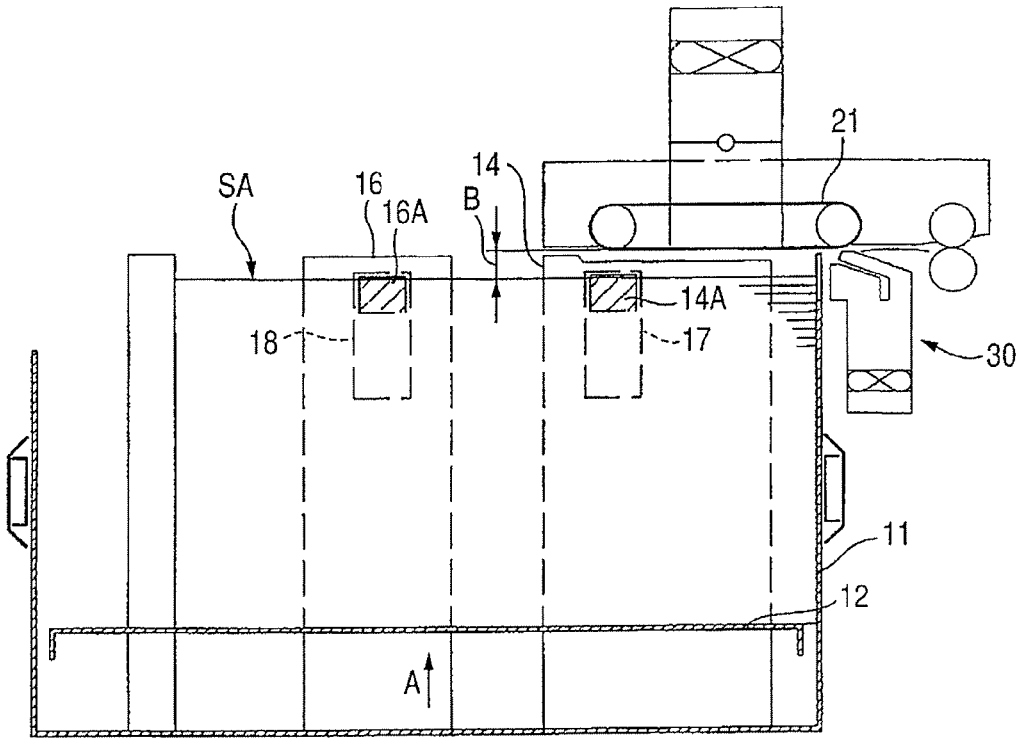
FIG. 21 is a first diagram for describing the sheet feeding operation of the sheet feeding apparatus illustrated in FIG. 21.
Figure 22:
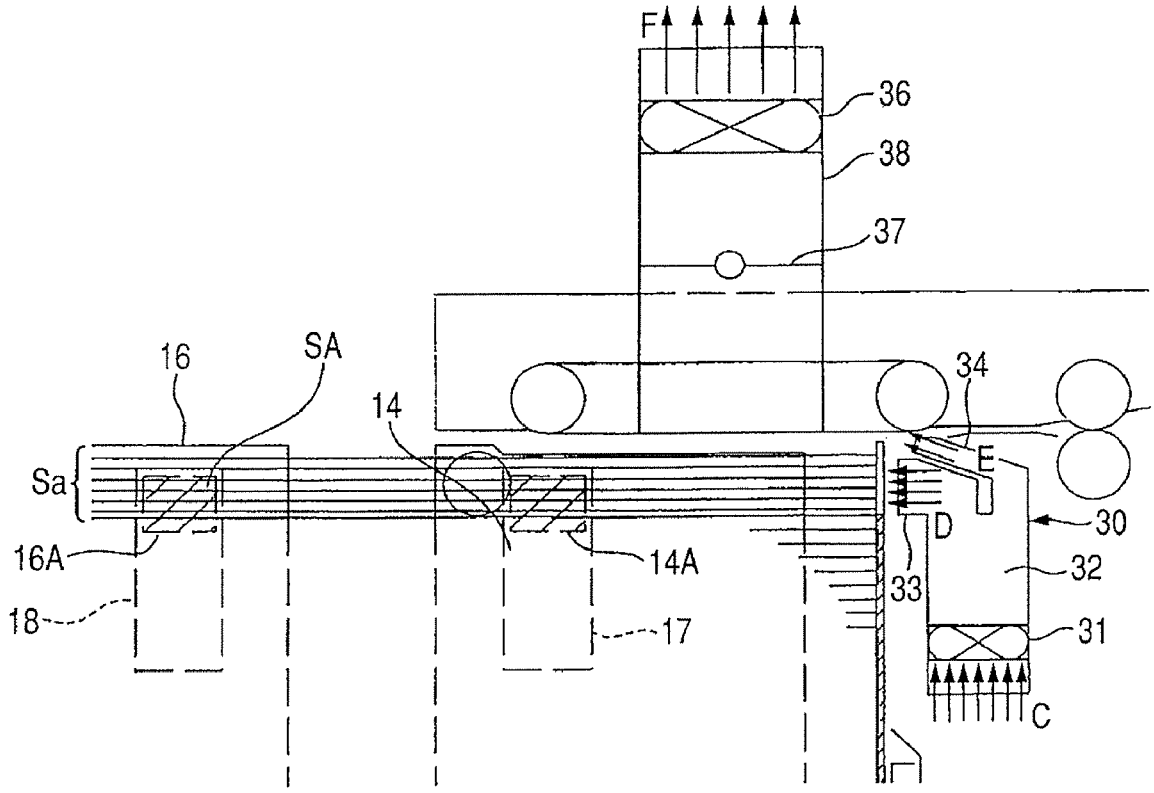
FIG. 22 is a second diagram for describing the sheet feeding operation of the sheet feeding apparatus illustrated in FIG. 21.
Figure 23:
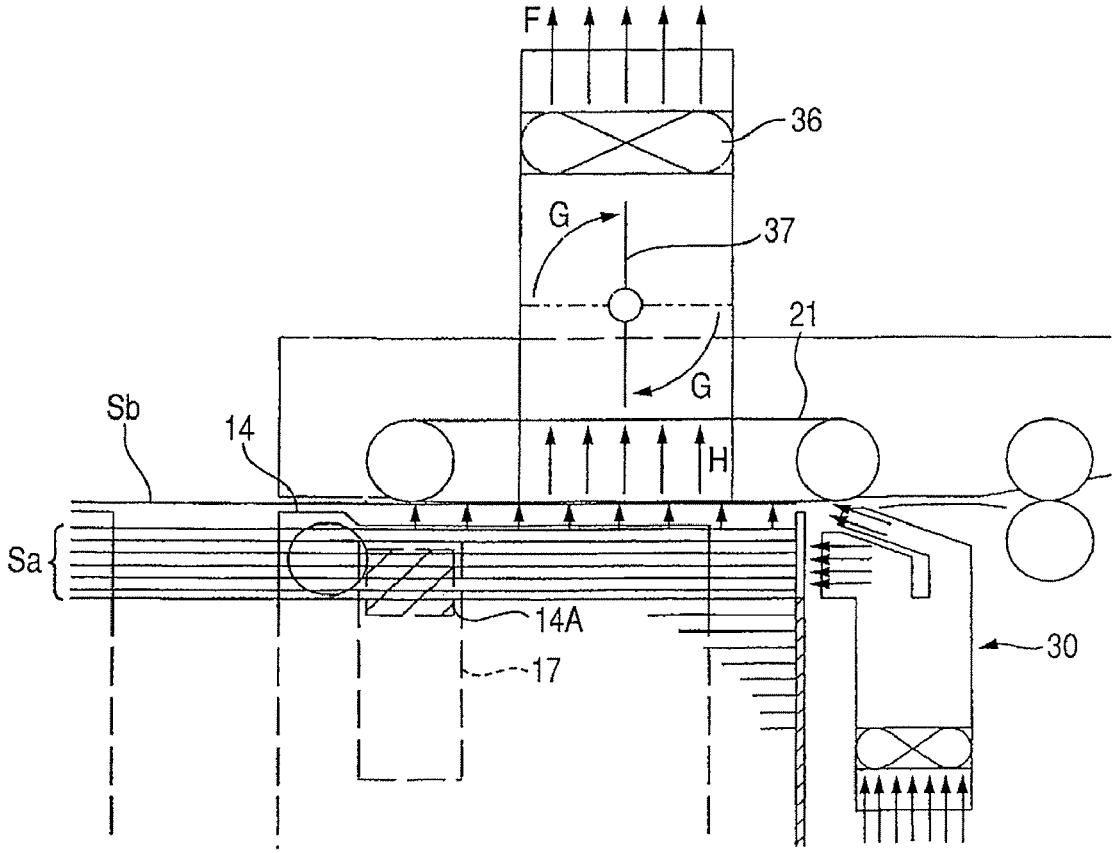
FIG. 23 is a third diagram for describing the sheet feeding operation of the sheet feeding apparatus illustrated in FIG. 21.
Figure 24:
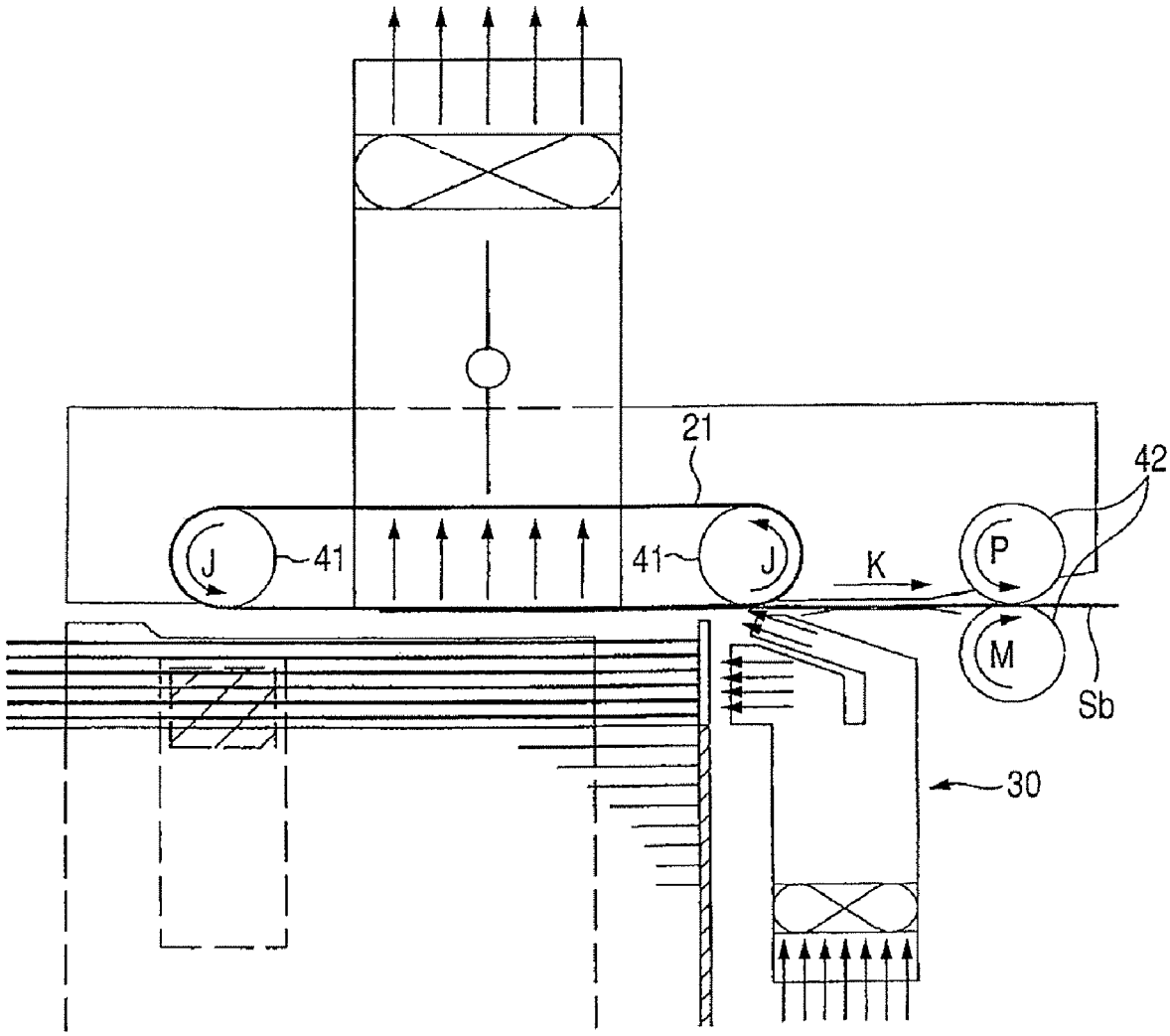
FIG. 24 is a fourth diagram for describing the sheet feeding operation of the sheet feeding apparatus illustrated in FIG. 21.

The rotational speed control of the four fans 51*a* to 52*b* will now be described with reference to a flowchart of FIG. 20.

The operation which is executed after the first to fourth fans 51*a* to 52*b* entered the rotational speed control after the power source was turned on, after the predetermined number of sheets were fed by the sheet feeding apparatus 103, or after the elapse of the predetermined time will be mainly described.

When the fans enters the rotational speed control (Y in step S101), first, the first to fourth fans 51*a* to 52*b* are turned on (S102). Subsequently, after the elapse of the predetermined time after the operations of the first to fourth fans 51*a* to 52*b* had been started (Y in S103), the rotational speed control of the first to fourth fans 51*a* to 52*b* is started (S104).

Subsequently, the control unit discriminates whether or not the rotational speeds of the first to fourth fans 51*a* to 52*b* have been within the predetermined target rotational speed range within the predetermined time after the start of the rotational speed control of the first to fourth fans 51*a* to 52*b* (S105, S110). If the rotational speeds of the first to fourth fans 51*a* to 52*b* are not within the predetermined target rotational speed range (N in S105 and Y in S110), the rotational speed control of the first to fourth fans 51*a* to 52*b* is finished. The first to fourth fans 51*a* to 52*b* are turned off (S111). Further, a warning showing the failure of the rotational speed control is displayed as shown in FIG. 14 (S112).

As mentioned above, when the apparatus fails in the rotational speed control, in order to prevent the operation of the sheet feeding apparatus 103 from being stopped, a predetermined value is set as a PWM value into each of the first to fourth fans 51*a* to 52*b* or to the fans 51*a* to 52*b* in which the apparatus has failed in the rotational speed control (S113). The previous PWM value can be also set as a PWM value which is set as mentioned above. After that, the set PWM values of the first to fourth fans 51*a* to 52*b* are stored into the memory (refer to FIG. 9) (S107). If the rotational speed control of the first to fourth fans 51*a* to 52*b* have reached the values within the predetermined target rotational speed range within the predetermined time after the rotational speed control to the first to fourth fans 51*a* to 52*b* had been started (Y in S105), the rotational speed control of the first to fourth fans 51*a* to 52*b* is finished. The first to fourth fans 51*a* to 52*b* are turned off (S106).

The PWM values of the first to fourth fans 51*a* to 52*b* which have been set as mentioned above are stored into the memory (S107). After that, the PWM value of each sheet type is determined by using the coefficients (refer to FIG. 11) allocated every sheet type as mentioned above.

In the above description, when the apparatus fails in the rotational speed control, the predetermined value is set as a PWM value or the previous PWM value is set. However, the invention is not limited to such a method. For example, when the warning indicative of the failure of the rotational speed control is displayed as shown in FIG. 14 (S112), subsequently, the value of the correction coefficient α mentioned above is automatically changed and whether or not the speed control is retried is selected (S115).

For example, if the rotational speeds of the first to fourth fans 51*a* to 52*b* are close to the target rotational speed range, the value of the correction coefficient α is automatically changed and the speed control is retried. If the change in the correction coefficient and the retry of the speed control are selected as mentioned above (Y in S115), the first to fourth fans 51*a* to 52*b* are turned on again (S102) and the rotational speed control is started.

As mentioned above, the rotational speeds of a plurality of fans 51*a* to 52*b* are controlled in such a manner that the wind pressure adapted to enable the sheets to be loosened in the state where all of the fans have been driven is obtained and the those rotational speeds are within the target rotational speed range which has been preset every plural fans 51*a* to 52*b*. Thus, the sheets can be certainly fed without being influenced by the aging change of the fan characteristics or the like and without causing the double feeding and a paper jam.

Although the embodiment has been described above with respect to the case of controlling the all of the first to fourth fans 51*a* to 52*b* individually, the invention is not limited to such a construction. For example, the control unit can control rotational speeds of at least two of the plurality of fans.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2006-135892, filed May 15, 2006, and 2007-097891, filed Apr. 3, 2007, which are hereby incorporated by reference herein in their entirety.

What is claimed is:

1. An apparatus having a sheet feeding apparatus for blowing an air to sheets stacked on a tray, loosening the sheets, and feeding the loosened sheet toward an image forming unit, comprising:

an air blowing mechanism which is constructed by combining a plurality of fans in order to blow the air to the sheets stacked on the tray;

a control unit which controls the air blowing mechanism so as to form a set wind pressure by combining the plurality of fans, the control unit controlling rotational speeds of at least two of the plurality of fans, individually, wherein the control unit controls rotational speeds of at least two of the plurality of fans of the air blowing mechanism so as to be equal to a target rotational speed set for each of the plurality of fans so that the set wind pressure can be obtained, wherein the control device discriminates whether or not the rotational speeds of the plurality of fans are within target rotational speed ranges which have been set for the plurality of fans, and wherein the rotational speeds of the plurality of fans are controlled by PWM control and if it is determined by the control device that the rotational speeds of the plurality of fans are not within the target rotational speed ranges, a PWM value of the fan whose rotational speed is not within the target rotational speed range is adjusted; and a memory which stores the PWM values of the every plurality of fans at the time when it is determined by the control device that the rotational speeds of the plurality of fans are within the target rotational speed ranges, wherein if it is determined by the control device that the rotational speeds of the plurality of fans are not within the target rotational speed ranges, the PWM value of the fan whose rotational speed is not within the target rotational speed range is set to the PWM value stored in the memory.

2. An apparatus having a sheet feeding apparatus for blowing an air to sheets stacked on a tray, loosening the sheets, and feeding the loosened sheet toward an image forming unit, comprising:

an air blowing mechanism which is constructed by combining a plurality of fans in order to blow the air to the sheets stacked on the tray;

a control unit which controls the air blowing mechanism so as to form a set wind pressure by combining the plurality of fans, the control unit controlling rotational speeds of at least two of the plurality of fans, individually, wherein the control unit controls rotational speeds of at least two of the plurality of fans of the air blowing mechanism so as to be equal to a target rotational speed set for each of the plurality of fans so that the set wind pressure can be obtained, wherein the control device discriminates whether or not the rotational speeds of the plurality of fans are within target rotational speed ranges which have been set for the plurality of fans, and wherein the rotational speeds of the plurality of fans are controlled by PWM control and if it is determined by the control device that the rotational speeds of the plurality of fans are not within the target rotational speed ranges, a PWM value of the fan whose rotational speed is not within the target rotational speed range is adjusted; and a memory which stores the PWM values of the every plurality of fans at the time when it is determined by the control device that the rotational speeds of the plurality of fans are within the target rotational speed ranges, wherein the PWM values of the every plurality of fans stored in the memory are corrected according to a type of sheet which is fed and the fans are controlled based on the corrected PWM values.

* * * * *